US010379487B2

(12) United States Patent
Matsumoto et al.

(10) Patent No.: US 10,379,487 B2
(45) Date of Patent: Aug. 13, 2019

(54) APPARATUS FOR DETERMINING WHETHER DOOR IS OPEN OR CLOSED AND IMAGE FORMING APPARATUS

(71) Applicant: CANON KABUSHIKI KAISHA, Tokyo (JP)

(72) Inventors: Shinichiro Matsumoto, Yokohama (JP); Daisuke Miyagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 15/292,804

(22) Filed: Oct. 13, 2016

(65) Prior Publication Data

US 2017/0108819 A1 Apr. 20, 2017

(30) Foreign Application Priority Data

Oct. 15, 2015 (JP) ..... 2015-203803
Jul. 27, 2016 (JP) ..... 2016-147495

(51) Int. Cl.
*G03G 15/00* (2006.01)
*G03G 21/16* (2006.01)

(52) U.S. Cl.
CPC ..... *G03G 21/1623* (2013.01); *G03G 15/50* (2013.01)

(58) Field of Classification Search
CPC ..... G03G 21/1623; G03G 15/50; G03G 15/80
See application file for complete search history.

(56) References Cited

U.S. PATENT DOCUMENTS

| | | | | |
|---|---|---|---|---|
| 5,101,252 | A | 3/1992 | Matsumoto | |
| 7,355,864 | B2 | 4/2008 | Matsumoto | |
| 7,577,004 | B2 | 8/2009 | Matsumoto | |
| 7,761,022 | B2 * | 7/2010 | Seo | G03G 15/5004 399/125 |
| 8,761,616 | B2 * | 6/2014 | Hotogi | G03G 15/80 399/9 |
| 8,903,263 | B2 | 12/2014 | Matsumoto | |
| 9,274,491 | B2 | 3/2016 | Matsumoto | |
| 9,306,453 | B2 | 4/2016 | Matsumoto | |
| 9,356,525 | B2 | 5/2016 | Matsumoto | |
| 9,459,584 | B2 * | 10/2016 | Kobayashi | G03G 15/043 |
| 2002/0116368 | A1 | 8/2002 | Matsumoto | |
| 2014/0240752 | A1 * | 8/2014 | Fujita | G06F 3/1234 358/1.14 |

FOREIGN PATENT DOCUMENTS

JP 2004-138893 A 5/2004

* cited by examiner

*Primary Examiner* — Benjamin R Schmitt
*Assistant Examiner* — Milton Gonzalez
(74) *Attorney, Agent, or Firm* — Venable LLP

(57) ABSTRACT

An open-close discriminating apparatus includes an output portion configured to output a DC voltage having been converted from an AC voltage; a switch portion having an end connected with the output portion, the switch portion being configured to supply the DC voltage outputted to the output portion to a load when the switch portion is in a closed state, and to shut off the supply when the switch portion is in an open state; a capacitor connected with the other end of the switch portion; and a discriminating portion configured to discriminate whether the switch portion is in the open state or the closed state on the basis of a change amount of a voltage of the other end of the switch portion in a predetermined time period.

18 Claims, 14 Drawing Sheets

(a)

(b)

(a)

(b)

APPARATUS FOR DETERMINING WHETHER DOOR IS OPEN OR CLOSED AND IMAGE FORMING APPARATUS

FIELD OF THE INVENTION AND RELATED ART

The present invention relates to an apparatus for determining whether a door is open or closed and an image forming apparatus. In particular, it relates to an image forming apparatus having a door for accessing the interior of the apparatus and an apparatus for determining whether the door is open or closed.

Generally speaking, an image forming apparatus is provided with a door 19, as shown in FIG. 7, for example, which is for allowing an operator to access the interior of the apparatus (for example, Japanese Laid-open Patent Application No. 2004-138893). This type of image forming apparatus is provided with a switch 25 for detecting whether the door 19 is open or closed. The switch 25 is connected as shown in part (a) of FIG. 8. A CPU 100 determines whether the door 19 is open or closed, by detecting the value of voltage Vad. The image forming apparatus is enabled to operate in the normal mode or economy mode. As the image forming apparatus is switched in its operation mode from the normal mode to the economy mode, a low voltage power source 110 is reduced in its output voltage Vcc. In the normal mode, the CPU 100 uses a voltage value Vth2 as the threshold value to determine whether the door 19 is open or closed, whereas in the economy mode, the CPU 100 uses a voltage value Vth1 (part (b) of FIG. 8) to determine whether the door 19 is open or closed. Further, referring to part (a) of FIG. 8, for the purpose of voltage stabilization, there is provided a pair of condensers Ca and Cd, which are in connection to one end of the switch 25 and the other. Therefore, as the image forming apparatus is switched in operational mode from the normal mode to the economy mode, the voltage Vad becomes stable after the elapse of the length of time necessary for the condensers Ca and Cb to discharge (part (a) of FIG. 9). By the way, FIGS. 7-9 are described later in detail.

The conventional method for detecting whether the door 19 is open or closed suffers from the following issue. As the image forming apparatus is switched in operational mode from the normal mode to the economy mode, the low voltage power source 110 is reduced in its output voltage Vcc. As the low voltage power source 110 reduces its output voltage Vcc, the voltage Vad also reduces. Referring to part (b) of FIG. 9, if the door 19 is opened and closed in a short length of time, for example, a period between a point ta to point tb in time, during a period between a point t8 and a point t9 in time while the voltage Vad is low, the following will occur. That is, if the door 19 is opened and closed in a short length of time, for example, the period between point ta to point tb in time, the voltage Vb of the terminal Sd of the switch 25 does not instantly become zero, since it is in connection to the condenser Cb. That is, the voltage Vad does not fall below the threshold voltage Vth1 for the economy mode. Therefore, the CPU 100 cannot detect that the door 19 is open.

Referring to FIG. 7, the image forming apparatus is provided with a contact 15, and a contact arm 16 to which the contact 15 is attached. Further, the contact arm 16 is mechanically connected to the door 19. Thus, as the door 19 is opened, the contact arm 16 is rotationally moved by the movement of the door 19, causing thereby the contact 15 to be separated from a nonvolatile memory 17. Thus, it is possible that the information outputted by the CPU 100 during the period from point ta to point tb in time, to be written into the nonvolatile memory 17, will not be accurately written into the nonvolatile memory 17. Moreover, the CPU 100 cannot detect that the door 19 is open. Therefore, it is possible that the information intended to be written into the nonvolatile memory 17 during the period from point ta to point tb in time will not be recovered. Thus, it has been desired to more accurately detect whether the door 19 is open or closed, even if the low voltage power source 110 changes in its output voltage Vcc.

SUMMARY OF THE INVENTION

Thus, the object of the present invention is to make it possible to more accurately detect whether a door is open or closed, even if a power source changes in its output voltage.

According to an aspect of the present invention, there is provided an open-close discriminating apparatus, comprising: an output portion configured to output a DC voltage having been converted from an AC voltage; a switch portion having an end connected with said output portion, said switch portion being configured to supply the DC voltage outputted to said output portion to a load when said switch portion is in a closed state, and to shut off the supply when said switch portion is in an open state; a capacitor connected with the other end of said switch portion; and a discriminating portion configured to discriminate whether said switch portion is in the open state or the closed state on the basis of a change amount of a voltage of the other end of said switch portion in a predetermined time period.

According to another aspect of the present invention, there is provided an open-close discriminating apparatus, comprising: an output portion configured to output a DC voltage having been converted from an AC voltage; a switch portion having an end connected with said output portion, said switch portion being configured to supply the DC voltage outputted to said output portion to a load when said switch portion is in a closed state, and to shut off the supply when said switch portion is in an open state; a capacitor connected with the other end of said switch portion; and a first detecting portion configured to detect a voltage of the other end of said switch portion; a second detecting portion configured to detect a voltage of the other end of said switch portion; a switching portion operable in response to the DC voltage outputted from said output portion between said first detecting portion and said second detecting portion, for detecting the voltage of the other end; and a discriminating portion configured to discriminate whether said openable member is in the open state or closed state on the basis of a result of the detection by said first detecting portion or said second detecting portion.

According to a further aspect of the present invention, there is provided an image forming apparatus comprising: an output portion configured to output a DC voltage having been converted from an AC voltage; a switch portion having an end connected with said output portion, said switch portion being configured to supply the DC voltage outputted to said output portion to a load when said switch portion is in a closed state, and to shut off the supply when said switch portion is in an open state; a capacitor connected with the other end of said switch portion; and an openable member configured to permit access into said image forming apparatus, wherein said switch portion is in the open state when said openable member is opened, and when said switch portion is in the closed state when said openable member is closed; a discriminating portion configured to discriminate whether said switch portion is in the open state or the closed state on the basis of a change amount of a voltage of the other end of said switch portion in a predetermined time period.

According to a further aspect of the present invention, there is provided a image forming apparatus comprising: an output portion configured to output a DC voltage having been converted from an AC voltage; a switch portion having an end connected with said output portion, said switch portion being configured to supply the DC voltage outputted to said output portion to a load when said switch portion is in a closed state, and to shut off the supply when said switch portion is in an open state; a capacitor connected with the other end of said switch portion; an openable member configured to permit access into said image forming apparatus, wherein said switch portion is in the open state when said openable member is opened, and when said switch portion is in the closed state when said openable member is closed; a first detecting portion configured to detect a voltage of the other end of said switch portion; a second detecting portion configured to detect a voltage of the other end of said switch portion; a switching portion operable in response to the DC voltage outputted from said output portion between said first detecting portion and said second detecting portion, for detecting the voltage of the other end; and a discriminating portion configured to discriminate whether said openable member is in the open state or closed state on the basis of a result of the detection by said first detecting portion or said second detecting portion.

Further features of the present invention will become apparent from the following description of exemplary embodiments with reference to the attached drawings.

Figure 3:
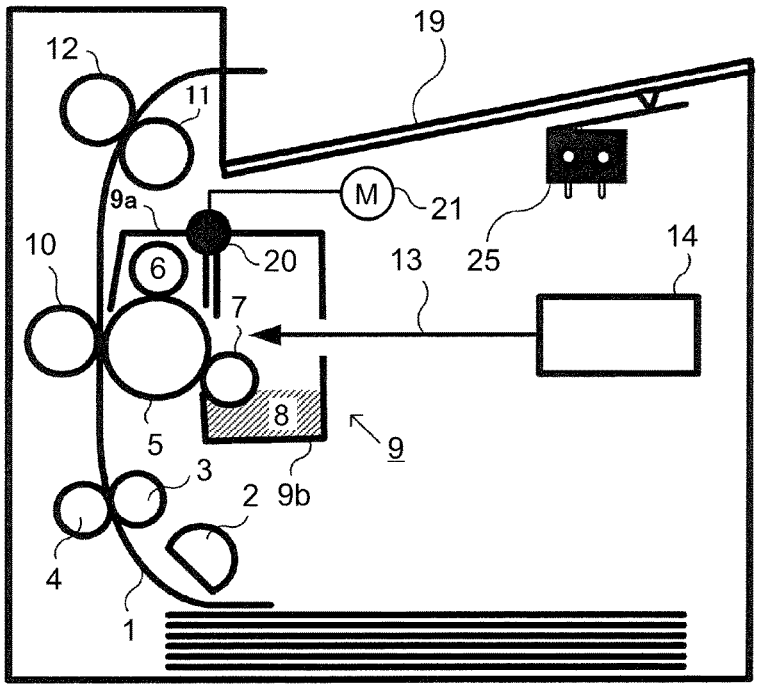
Figure 3:
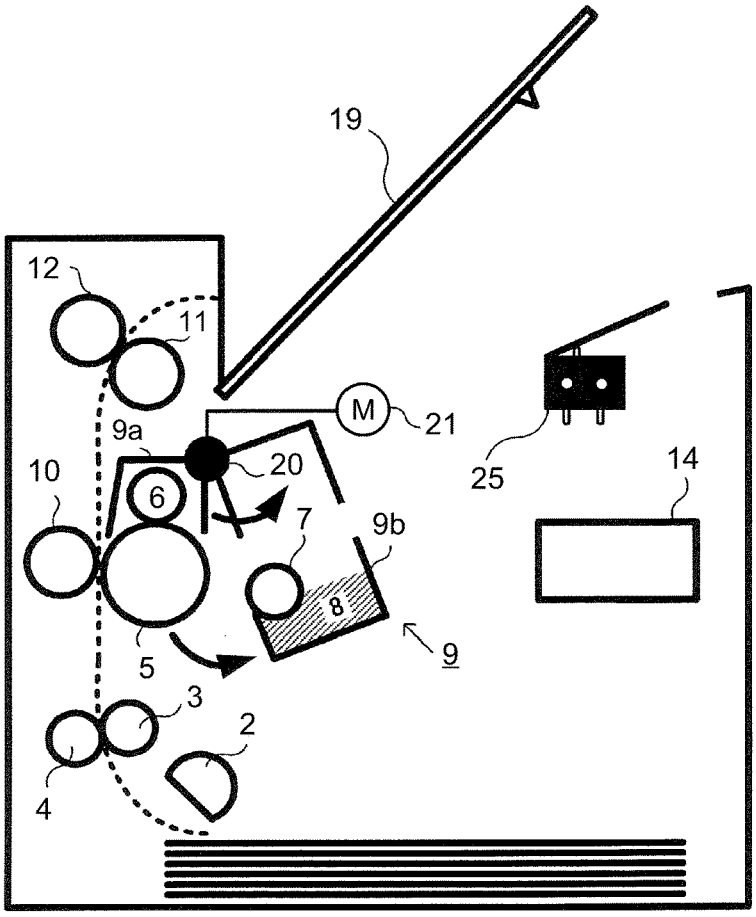

Parts (a) and (b) of FIG. 3 are drawings for showing the states of the image forming apparatus in the first embodiment, when the door of the apparatus is open and closed.

Figure 4:
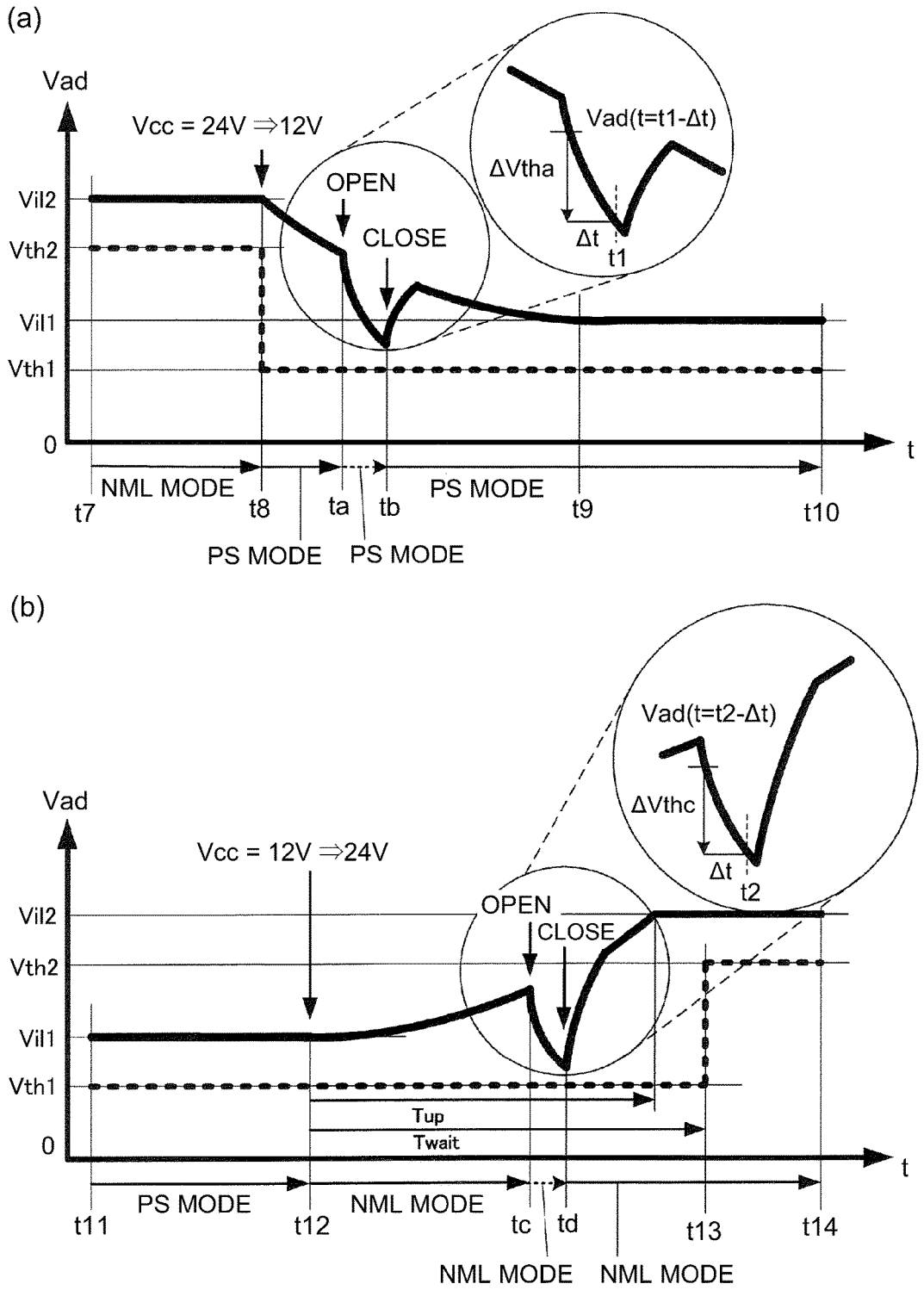

Parts (a) and (b) of FIG. 4 are drawings for describing the control sequence, in the second embodiment of the present invention, for detecting whether the door of the image forming apparatus is open or closed.

Figure 5:
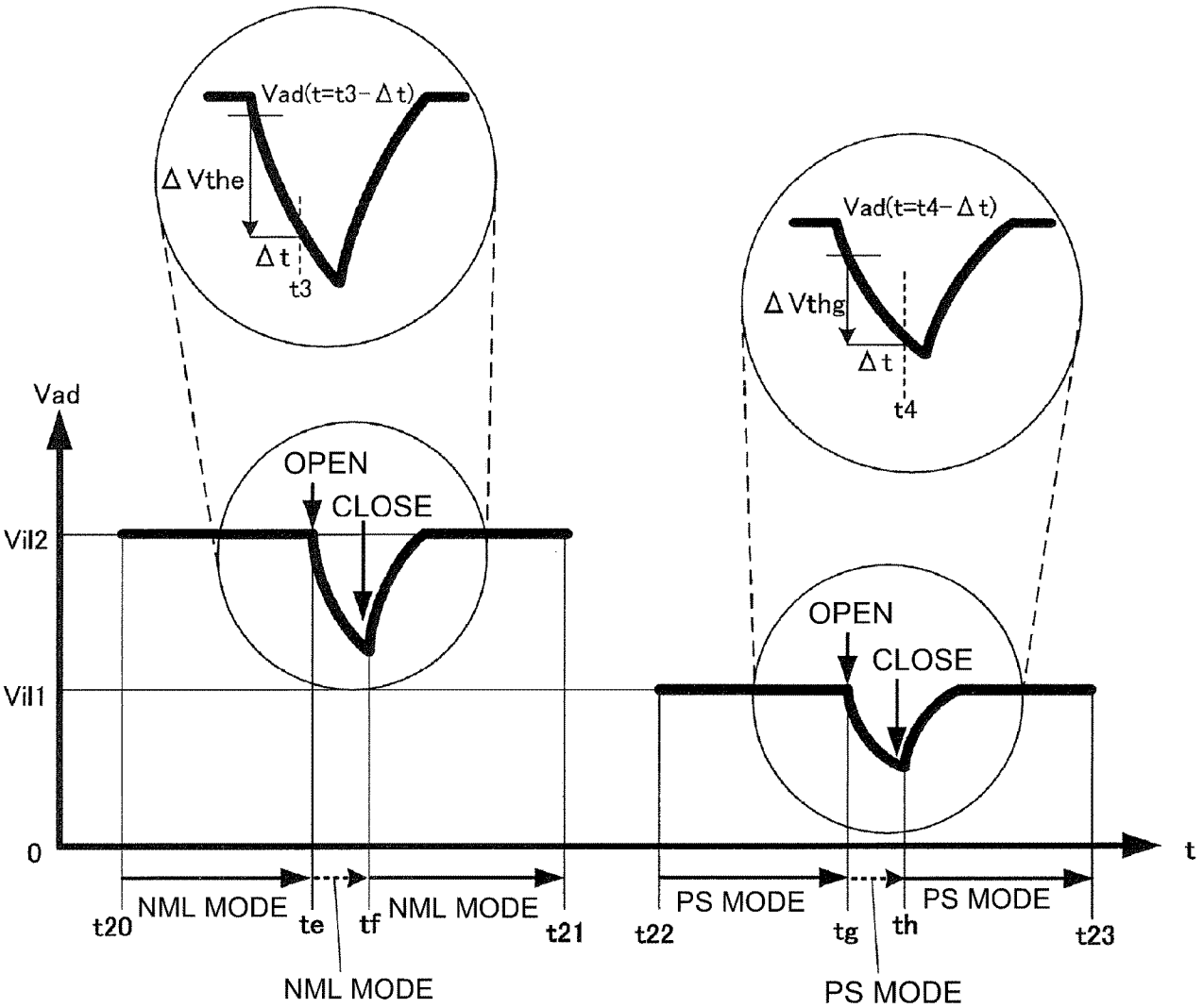

FIG. 5 is a drawing for describing the control sequence, in the third embodiment of the present invention, for detecting whether the door of the image forming apparatus is open or closed.

Figure 6:
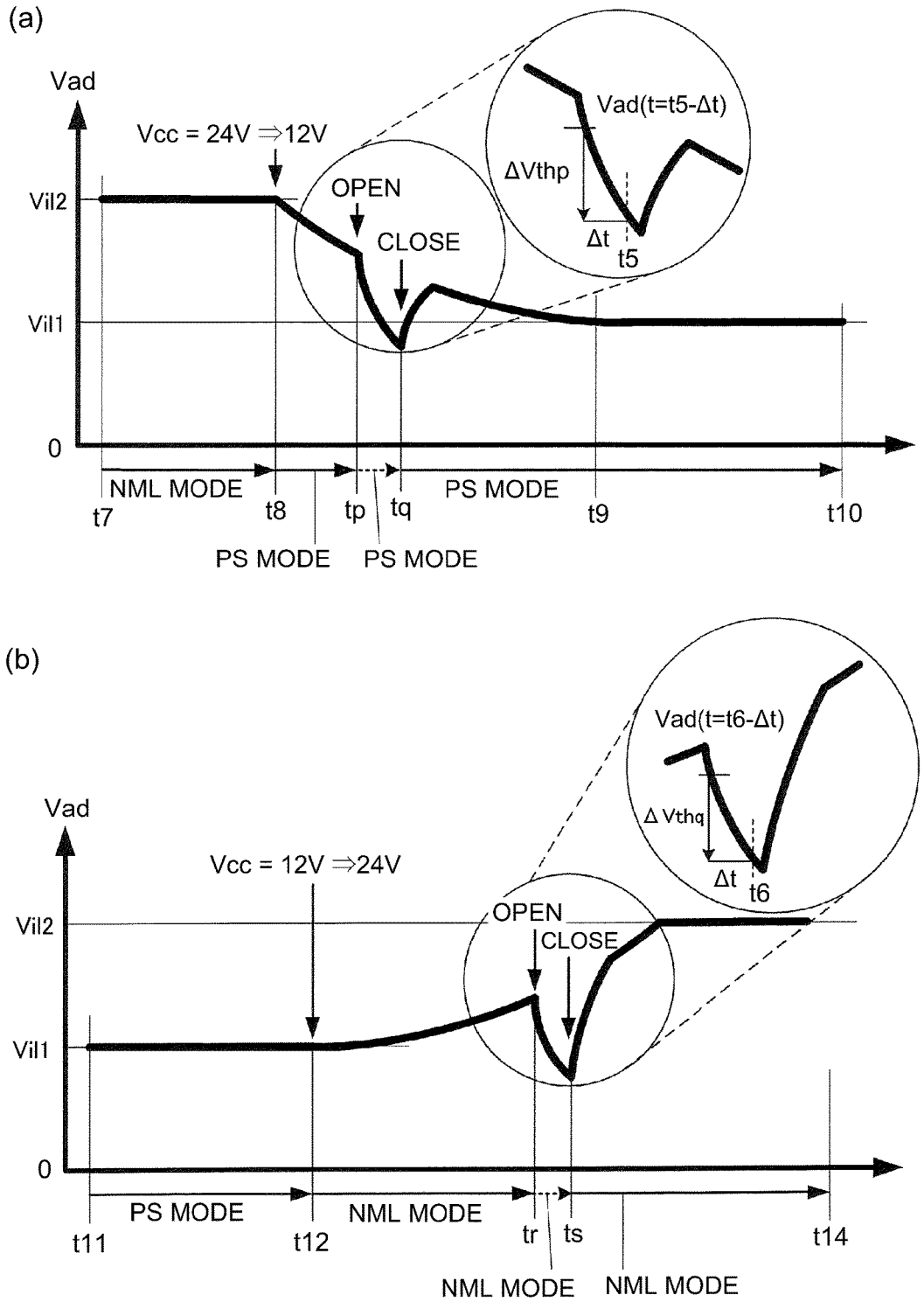

Parts (a) and (b) of FIG. 6 are drawings for describing the control sequence, in the third embodiment of the present invention, for detecting whether the door of the image forming apparatus is open or closed.

Figure 7:
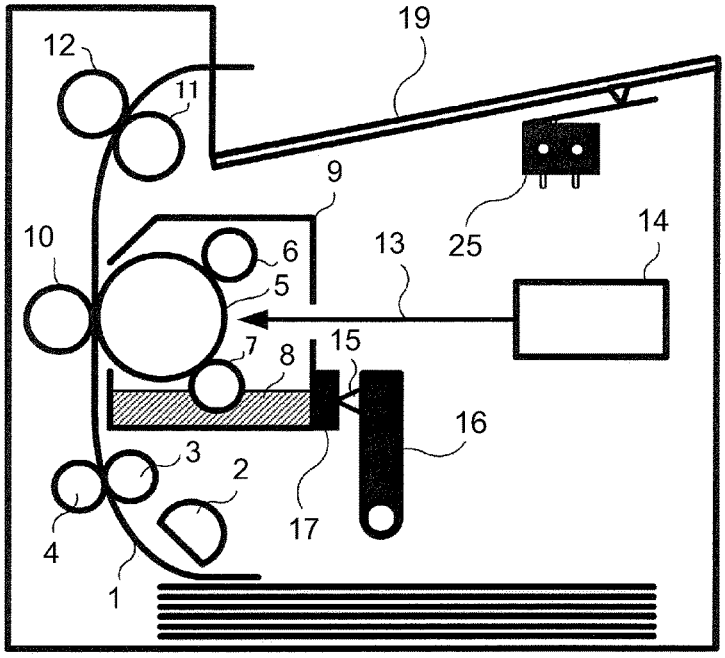
Fig. 7 PRIOR ART
Figure 7:
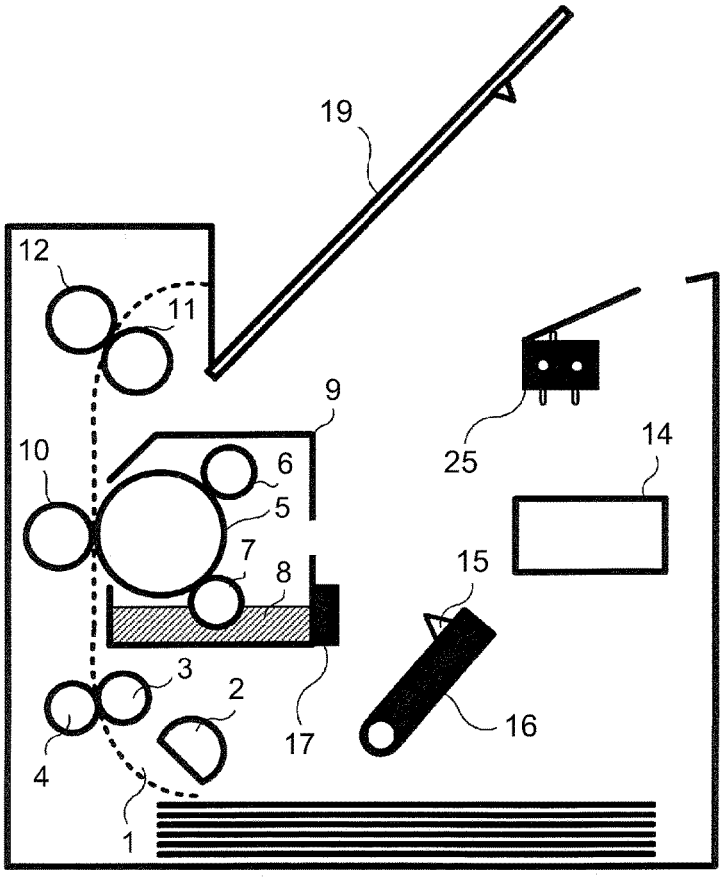
Fig. 7 PRIOR ART

Parts (a) and (b) of FIG. 7 are drawings for showing the states of a conventional image forming apparatus, when the door of the apparatus is open and closed.

Figure 8:
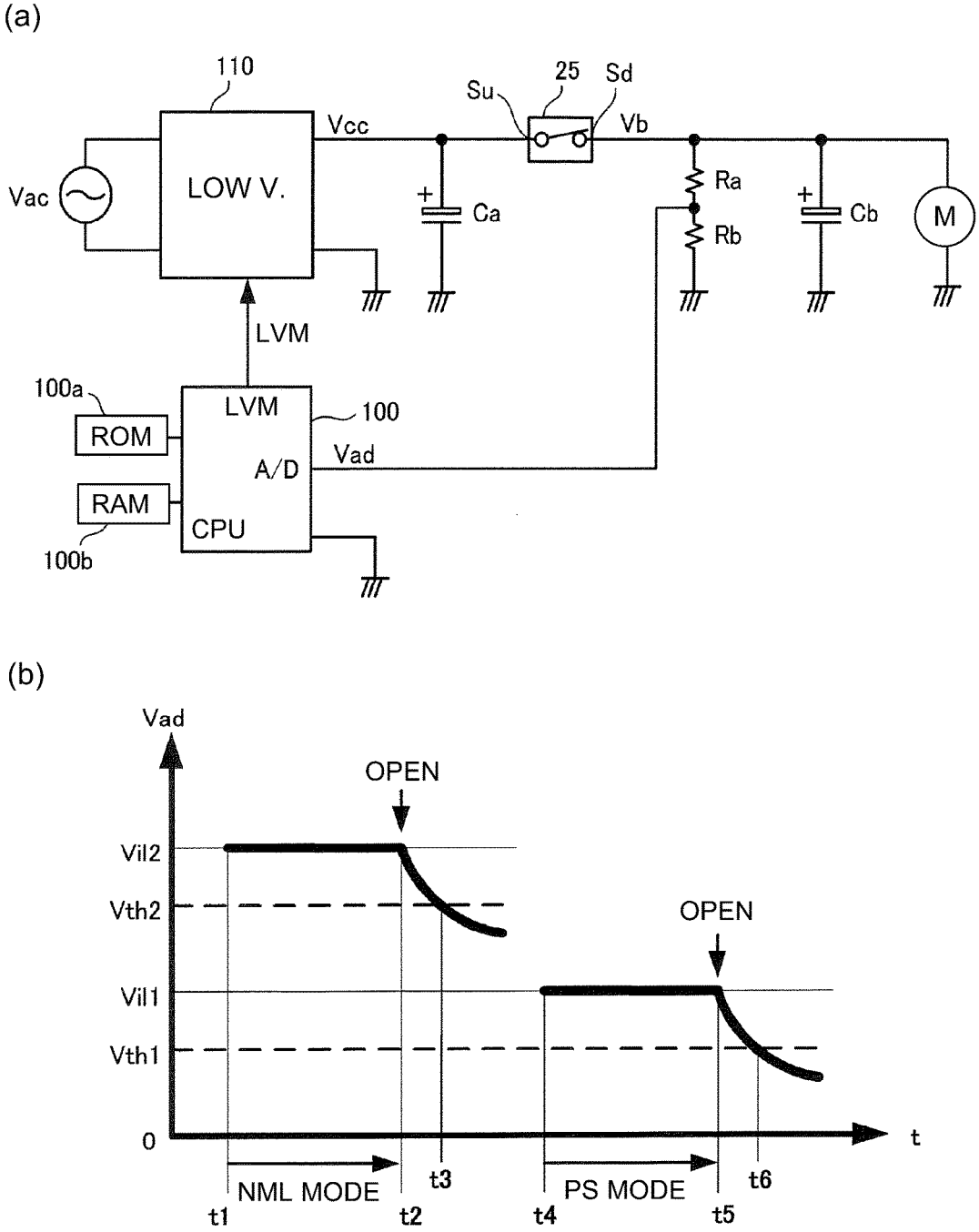
Fig. 8 PRIOR ART

Part (a) of FIG. 8 is a drawing for describing the connection of a switch with which the conventional image forming apparatus is provided to detect whether or not the door is open or closed, and part (b) of FIG. 8 is a drawing for describing the control sequence of the conventional image forming apparatus, for detecting whether the door an image forming apparatus is open or closed.

Figure 9:
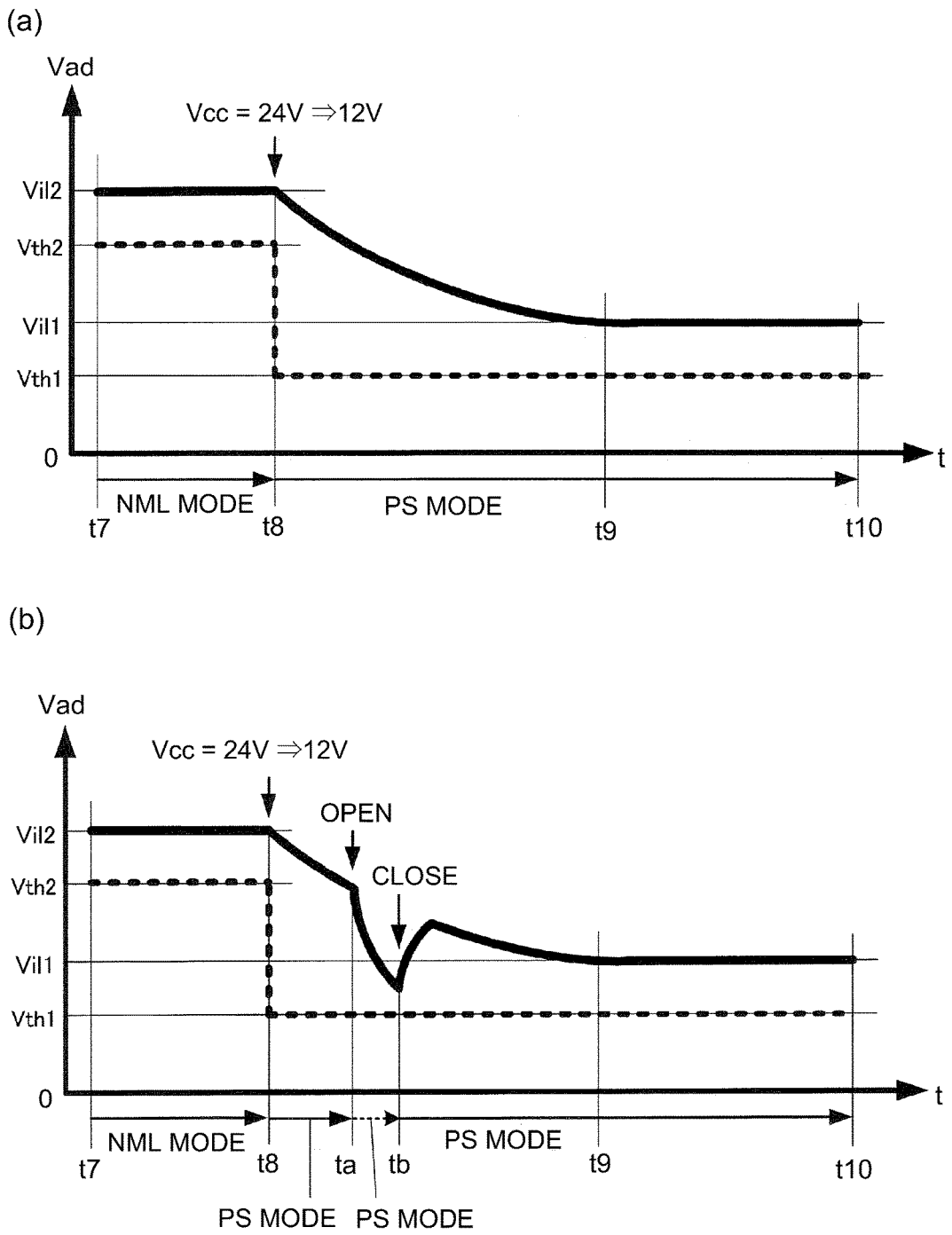
Fig. 9 PRIOR ART

Parts (a) and (b) of FIG. 9 are drawings for describing the control sequence of the conventional image forming apparatus, for detecting whether the door is open or closed.

Figure 10:
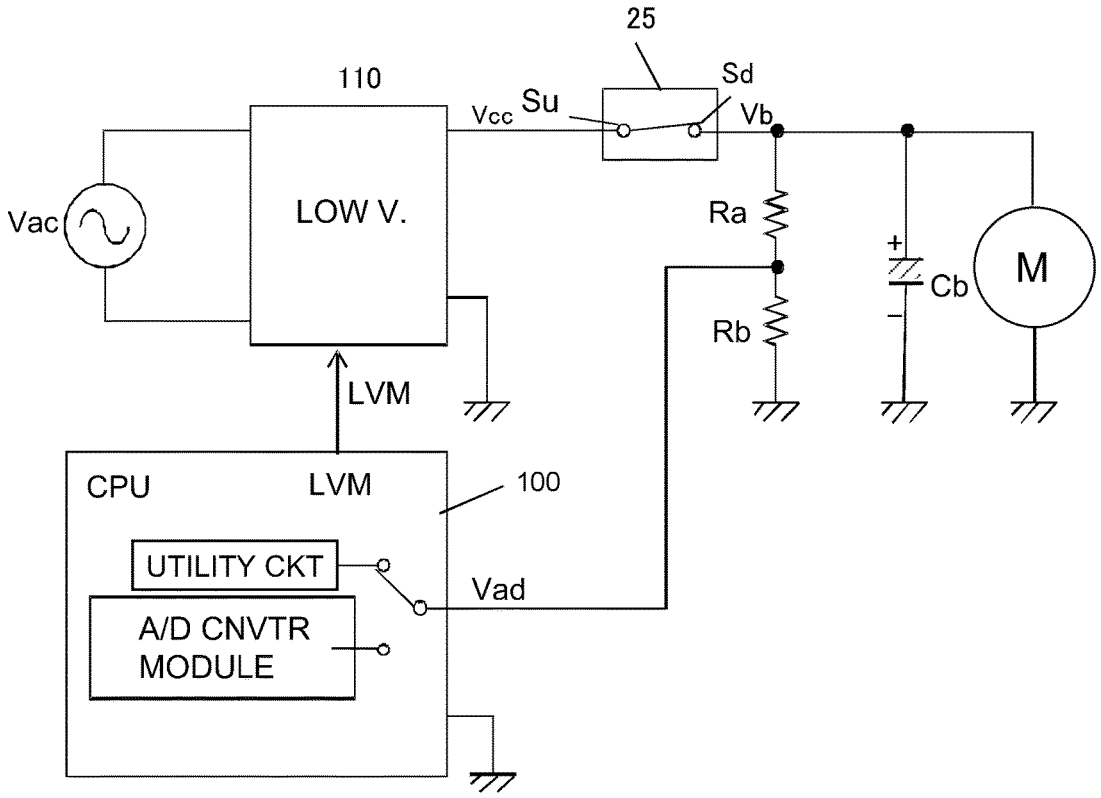

FIG. 10 is a diagram of the electrical circuit, in the fourth embodiment of the present invention, for detecting whether the door is open or closed.

Figure 11:
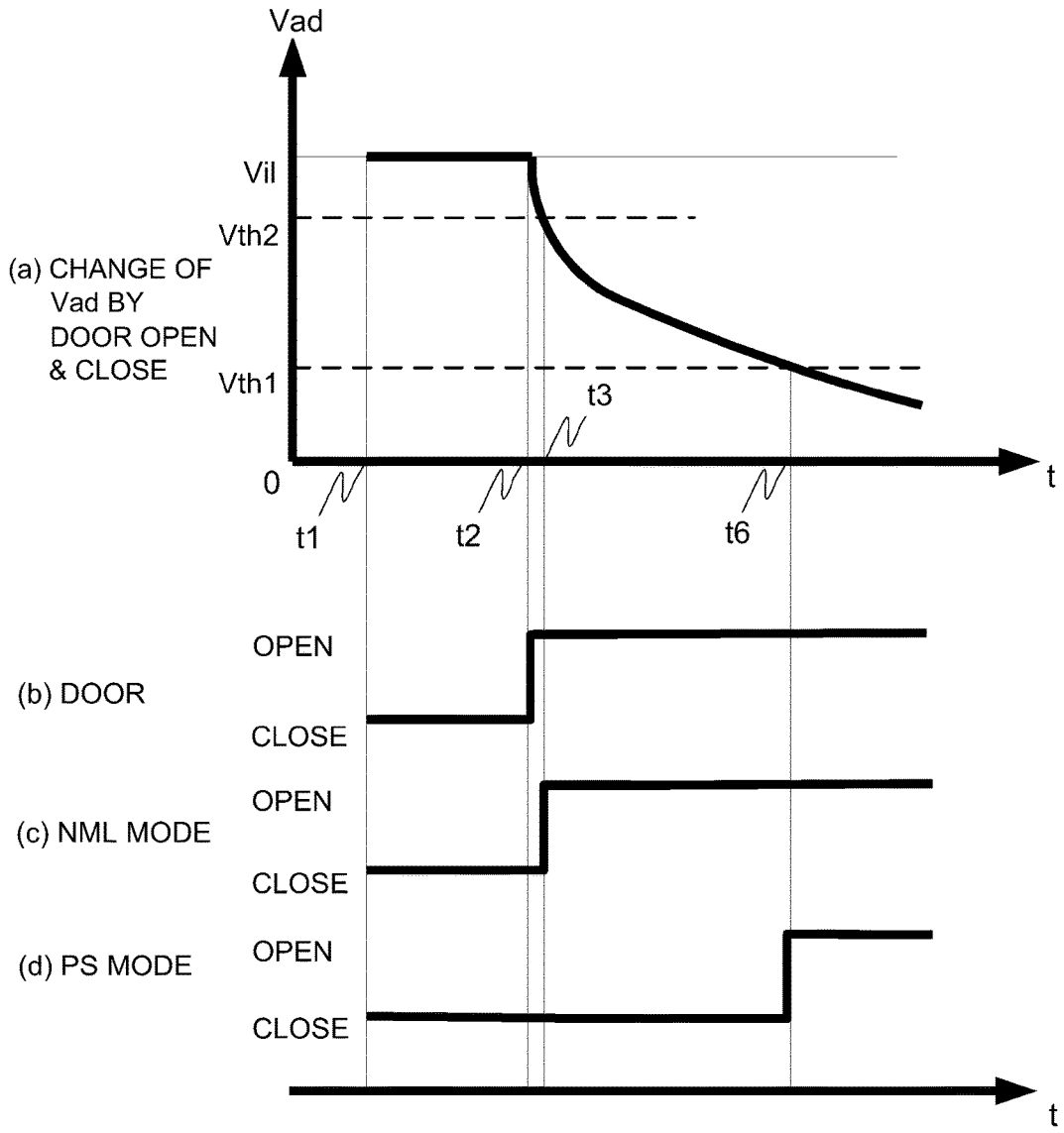

Parts (a)-(d) of FIG. 11 are a timing chart for the method, in the fourth embodiment, for detecting whether the door is open or closed.

Figure 12:
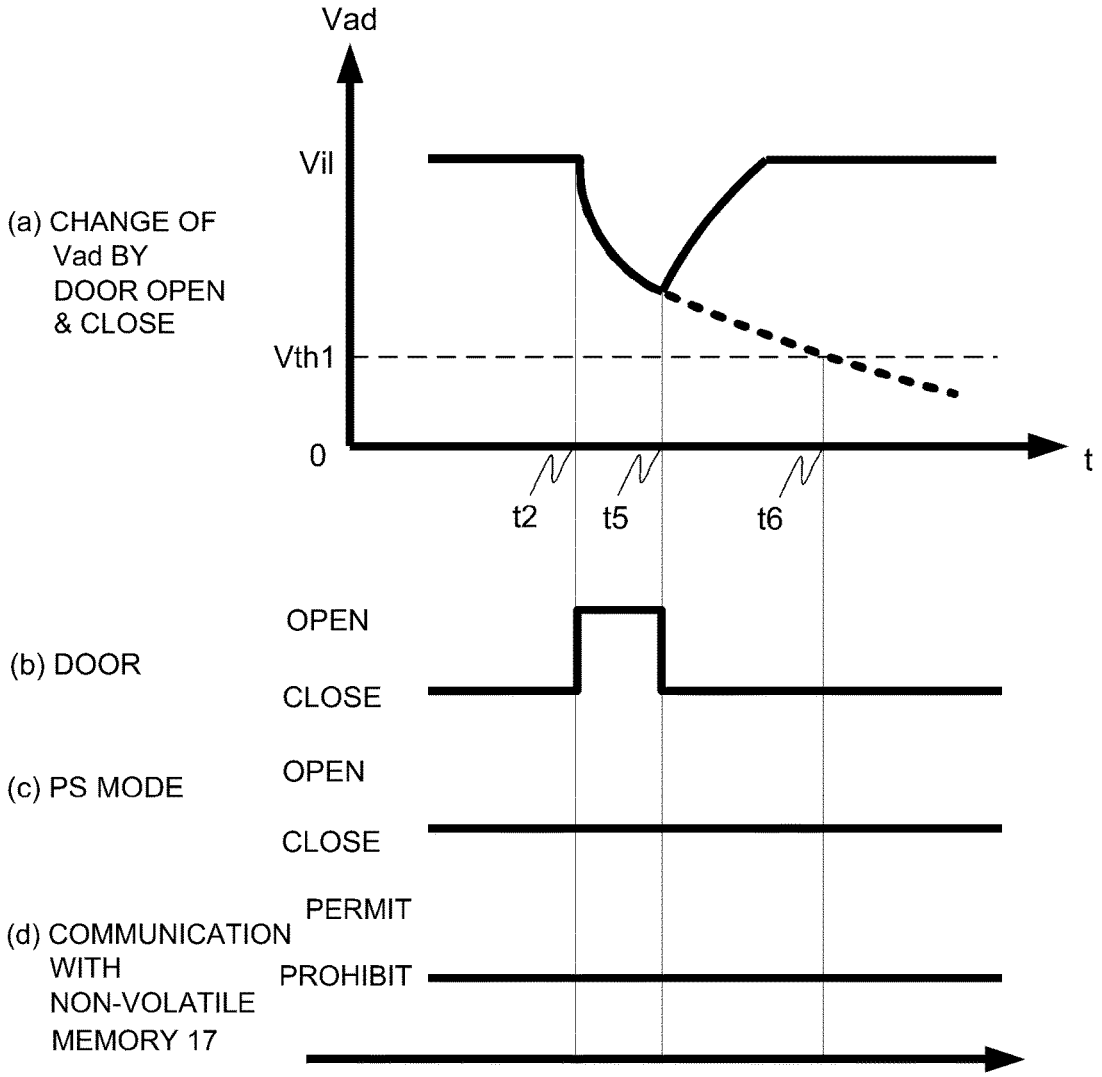

Parts (a)-(d) of FIG. 12 are a timing chart for the method, in the fourth embodiment, for detecting whether the door 19 is open or closed while the image forming apparatus is in the economy.

Figure 13:
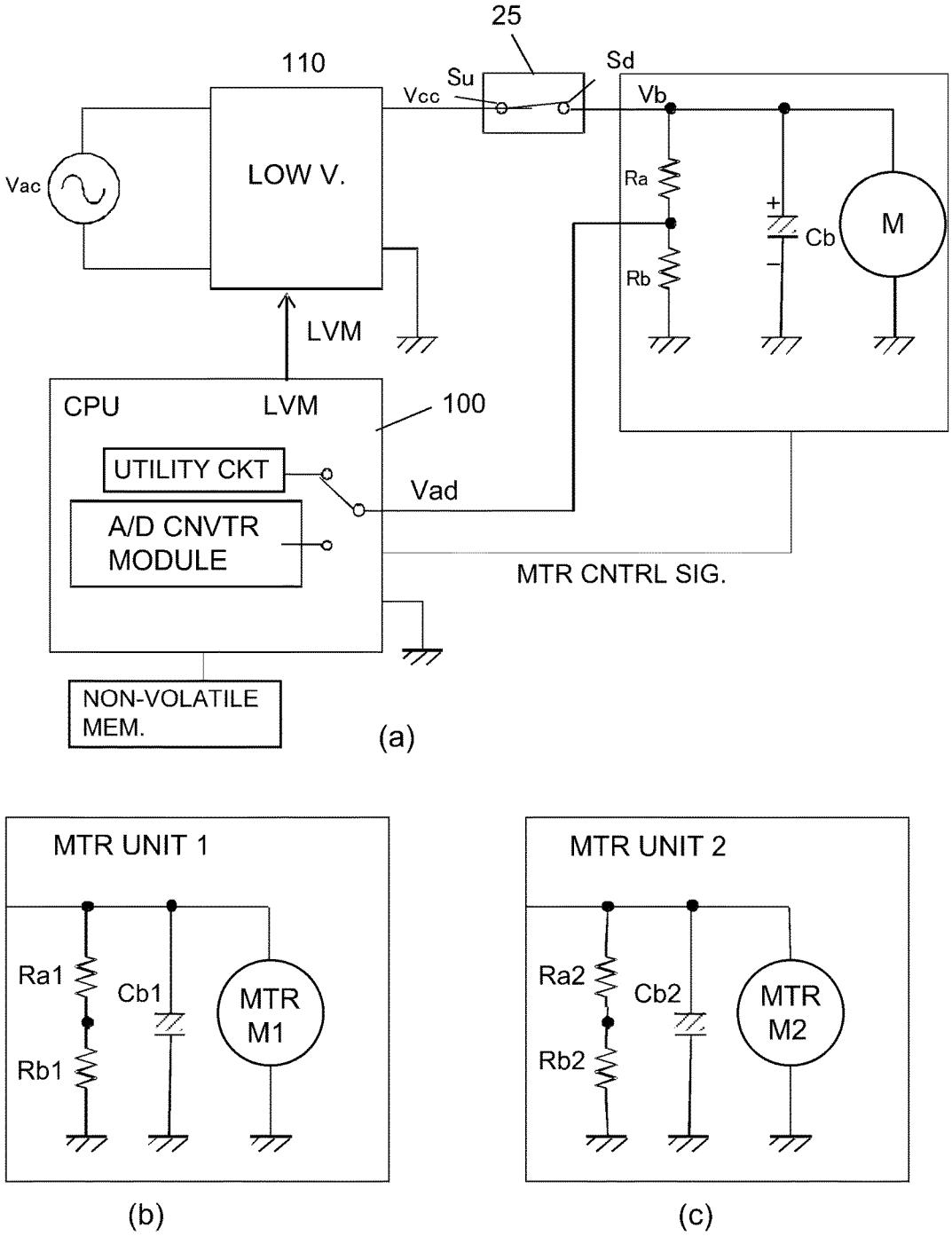

Parts (a)-(d) of FIG. 13 are a circuit diagram of the apparatus, in the fifth embodiment, for detecting whether the door is open or closed.

Figure 14:
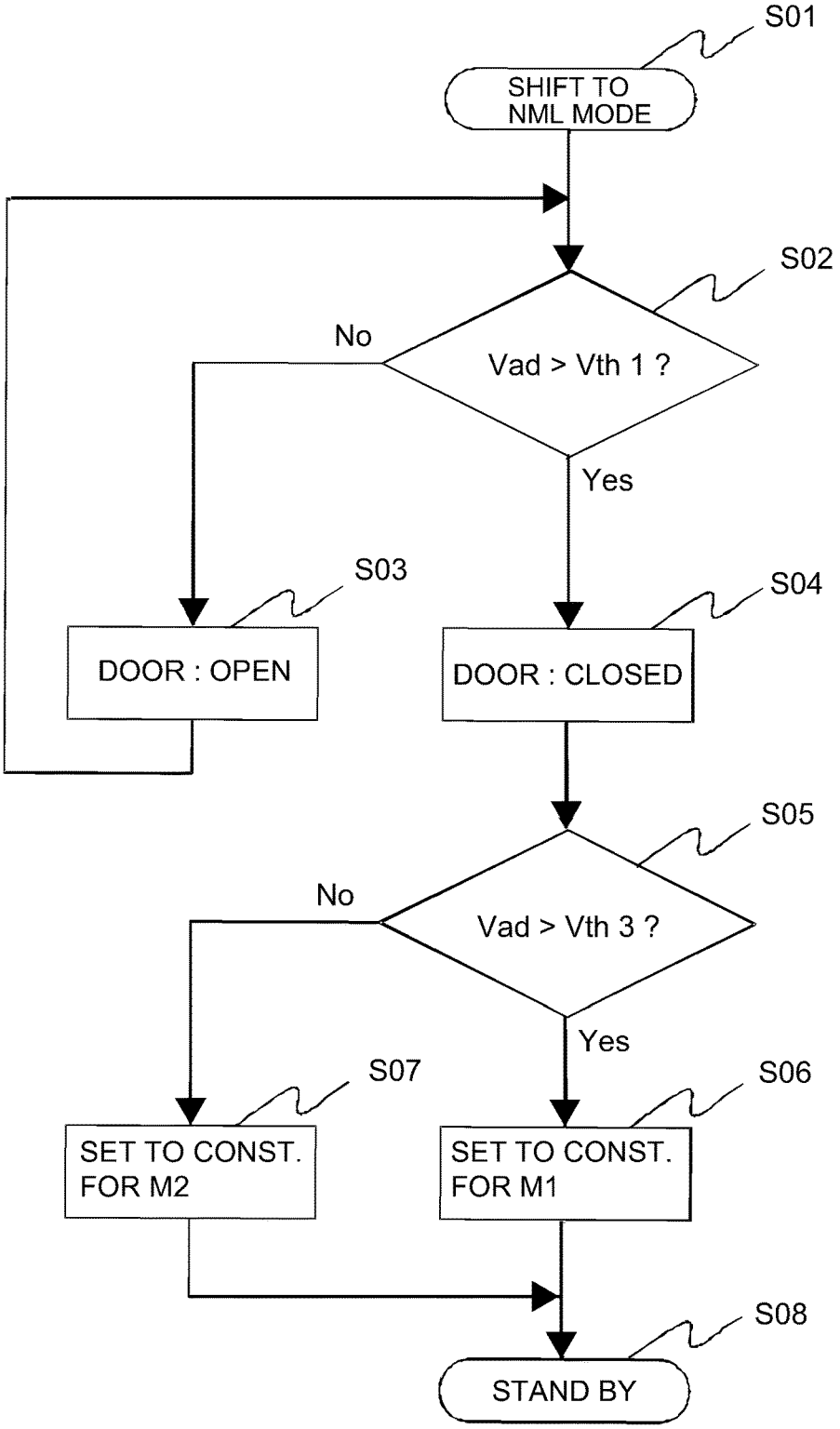

FIG. 14 is a flowchart of the control sequence to be carried out by the CPU 100 in the fifth embodiment.

DESCRIPTION OF THE EMBODIMENTS

[Image Forming Apparatus]

FIG. 7 is a drawing of a typical image forming apparatus to which the present invention is applicable. The image forming apparatus is provided with a door 19 for allowing a user to access the interior of the apparatus. Part (a) of FIG. 7 is a drawing of the apparatus when the door 19 is closed. A sheet 1 of recording paper, as recording medium, is fed into a recording medium conveyance passage by the rotation of a pickup roller 2. Then, it is conveyed by a pair of conveyance rollers 3 and 4 to a nip formed by a combination of a transfer roller 10 and a photosensitive drum 5. The photosensitive drum 5 is stored, along with a charge roller 6, a development sleeve 7, and toner 8, in a cartridge 9 which makes up an image forming portion and is removably mountable in the main assembly of the image forming apparatus. The photosensitive drum 5 is charged by the charge roller 6. Then, it is exposed to a beam 13 of light emitted by a laser scanner 14. Consequently, a latent image is formed on the peripheral surface of the photosensitive drum 5. The latent image formed on the photosensitive drum 5 is developed by the development sleeve 7, forming thereby a toner image (image formed of toner). Then, the sheet 1 is transferred the toner image, in the nip between the transfer roller 10 and photosensitive drum 5, is heated and pressed by a combination of a fixation roller 11 and a pressure roller 12, and then, is discharged out of the image forming apparatus.

The cartridge 9 is provided with a nonvolatile memory 17, in which the information, such as the remaining amount of the toner 8, related to the cartridge 9 is recorded. The information is written into the nonvolatile memory 17 through a contact 15 and an contact arm 16. That is, as the contact 15 comes into contact with a predetermined portion of the nonvolatile memory 17, the information is written into the nonvolatile memory 17. Further, the image forming apparatus is provided with a switch 25 which is switching means for detecting whether the door 19 is open (which may be referred to as open state) or closed (which may be referred to as closed state). The switch 25 is an interlocking switch, for example. It remains turned off when the door 19 is open, and remains turned on when the door 19 is closed.

Part (b) of FIG. 7 is drawing of the image forming apparatus when the door 19 is open. As the door 19 is opened as shown in part (b) of FIG. 7, the switch 25 is turned off. Further, as the closed door 19 is opened, the combination of the contact 15 and contact arm 16, which are mechanically connected to the door 19, are rotated by the movement of the door 19. Consequently, the contact 15 is separated from the preset point of the nonvolatile memory 17.

[Electrical Connection of Switch]

Next, referring to part (a) of FIG. 8, the electrical connection of the switch 25 is described. One end Su of the switch 25 is in connection to the output terminal of the low voltage power source 110, which is an outputting means, and the output voltage of which is Vcc. The low voltage power source 110 converts AC voltage Vac into DC voltage, and provides a load with the output voltage Vcc through the switch 25. By the way, when the door 19 is remaining closed, the switch 25 is on, and provides the load with electric power from the low voltage power source 110 (this condition will be referred to as "switch is on"). On the other hand, when the door 19 is open, the switch 25 is off, and prevents electric power from being supplied to the load from the low voltage power source 110 (this condition will be referred to as "switch is off"). The other end Sd of the switch 25 is in connection to a motor M. By the way, the voltage with which the other end Sd of the switch 25 is provided will be referred to as voltage Vb.

The motor M is for driving the mechanism for conveying the sheet 1 of paper and the like mechanism. It is one of the loads which are supplied with electric power by the low voltage power source 110. As the door 19 is closed, the switch 25 is turned off, interrupting the supply of electric power from the low voltage power source 110 to the motor M through the switch 25. Further, the other end Sd of the switch 25 is in connection to a pair of registers Ra and Rb, which divides the voltage Vb, with which the other end Sd of the switch 25 is provided. The voltage Vad, into which the voltage Vb was divided, is outputted to the analog/digital (A/D, hereafter) conversion input terminal of the CPU 100, which is a logic computation element. The CPU 100 carries out various programs stored in a ROM 100*a*, while using a RAM 100*b* as an operation area, to control various operations of the image forming apparatus. The CPU 100 determines whether the door 19 is open or closed, based on the value of the inputted voltage Vad. In order to keep the voltage Vad stable, the switch 25 is connected to a pair of condensers Ca and Cb. More concretely, one end Su of the switch 25 is in connection to the condenser Ca, whereas the other end Sd is in connection to the condenser Cb.

[Method for Detecting Whether Door is Open or Closed]

(Normal Mode)

part (b) of FIG. 8 shows the method for detecting whether the door 19 is open or closed. Part (b) of FIG. 8 is a graph, the horizontal and vertical axes of which represent elapsed time (t) and voltage (Vad), respectively. During the period from point t1 to point t2 in time, the door 19 is remaining closed, and the switch 25 is on. During this period, the output voltage Vcc has the value (24 V, for example) for the normal mode, in which the low voltage power source 110 supplies the image forming apparatus with the electric power necessary to carry out an image forming operation, and the value of the voltage Vad is Vil2. The CPU 100 compares the value of the voltage Vad with the value for a threshold voltage Vth2 (indicated by broken line in part (b) of FIG. 8) which is preset for the normal mode, in order to determine whether the door 19 is open or closed. More specifically, if the CPU 100 determines that the value of the voltage Vad is greater than the value of the threshold voltage Vth2 (Vth2<Vad), it determines that the door 19 is closed. On the other hand, if the CPU 100 determines that the value of the voltage Vad is no more than the value of the threshold voltage Vth2 (Vad≤Vth2), it determines that the door 19 is open. That is, during the period from point t1 to point 2 in time (part (b) of FIG. 8), the value (Vil2) of the voltage Vad is greater than the value of the threshold voltage Vth2 (Vil2>Vth2). Thus, the CPU 100 determines that the door 19 is closed. As the door 19 is opened at point t2 in time, the switch 25 is turned off, and the voltage Vad drops; the value of the Vad falls below the threshold voltage Vth2 at point t3 in time. Thus, the CPU 100 determines that the door 19 is open after point t3 in time.

(Economy Mode)

By the way, some image forming apparatuses are known to be structured so that while they are kept on standby, they can be put in the economy mode, in which the low voltage power source 110 is kept low in output voltage Vcc. The CPU 100 outputs an economy mode signal LVM to the low voltage power source 110 from a LVM terminal which is in connection to the low voltage power source 110. As the economy mode signal LVM is inputted into the low voltage power source 110 from the CPU 100, the low voltage power source 110 reduces its output voltage Vcc to a value (12 V, for example) preset for the economy mode.

Next, the control sequence to be carried out by the CPU 100 to detect whether the door 19 is open or closed while the image forming apparatus is in the economy mode is described. During the period from point t4 to point t5 in time, the door 19 remains closed. During this period, the value of the output voltage Vcc is the preset one (12 V, for example) for the economy mode, and the value of the voltage Vad is Vil1. The CPU 100 compares the value of the voltage Vad with the value preset for the threshold value Vth1 (indicated by broken line in part (b) of FIG. 8) for the economy mode, in order to determine whether the door 19 is open or closed. More concretely, if the CPU 100 determines that the value of the voltage Vad is greater than the value of the threshold voltage Vth1 (Vth1<Vad), it determines that the door 19 is closed. On the other hand, if the CPU 100 determines that the value of the voltage Vad is no more than the value of the threshold voltage Tth1 (Vad≤Vth1), it determines that the door 19 is open. That is, during the period from point t4 to point t5 in time in part (b) of FIG. 8, the value of the voltage Vad (=Vil1) is greater than the value of the threshold voltage Vth1 (Vil1>Vth1), the CPU 100 determines that the door 19 is closed. As the door 19 is opened at the point t5 in time, the switch 25 is turned off, and therefore, the voltage Vad continues to fall until its value becomes smaller than the value of the voltage Vad at point t6 in time. Thus, after point t6 in time, the CPU 100 determines that the door 19 is open.

[Method for Detecting Door is Open or Closed During Transitional Period from Normal Mode to Economy Mode]

Part (a) of FIG. 9 is a drawing for describing the control sequence carried out by the CPU 100 to detect whether the door 19 is open or closed during a period in which the image forming apparatus is changed in operational mode from the normal mode to the economy mode. Part (a) of FIG. 9 is such a graph that its horizontal and vertical axes represent the length of elapsed time (t), and the value of the voltage Vad, respectively. By the way, the portions of part (a) of FIG. 9, which are similar in description to the counterparts in part (b) of FIG. 8 are not described. During a period from point t7 to point t8 in time, the image forming apparatus is in the normal mode. During this period, the threshold voltage value used to detect whether the door 19 is open or closed is Vth2. The CPU 100 outputs an economy mode start signal LVM to the low voltage power source 110 to switch the image forming apparatus in operational mode from the normal mode to the economy mode. Not only does the CPU 100 changes the low voltage power source 110 in the output voltage Vcc from 24 V to 12 V, but it also switches the low voltage power source 110 in the threshold voltage value from Vth2 to Vth1 (indicated by broken line in part (a) of FIG. 9).

Referring to part (a) of FIG. 8, for voltage stabilization, one end of the switch 25 is connected to the condenser Ca, and the other end of the switch 25 is connected to the condenser Cb. Thus, it does not occur that as the image forming apparatus is switched in operational mode from the normal mode to the economy mode at point t8 in time, the low voltage power source 110 instantly changes in the value of the output voltage Vcc, and voltage Vad instantly changes in value. That is, the voltage Vad becomes stable in value after the elapse of the length of time from the point t8 to point t9 in time, that is, the length of time necessary for the condensers Ca and Cb to fully discharge. By the way, in part (a) of FIG. 9, the door 19 remains closed from point t7 to point 10 in time.

However, a method, such as the one described above, for detecting whether the door 19 is open or closed suffers from the following issues: as the image forming apparatus is switched in operational mode from the normal mode to the economy mode at point t8 in time, the output voltage Vcc of the low voltage power source 110 falls from 24 V to 12 V. Consequently, the voltage Vad also falls from Vil2 toward the Vil1, as shown in part (b) of FIG. 9. Here, part (b) of FIG. 9 is a drawing for describing what occurs if the door 19 is opened and closed in a length of time, which is shorter than the length of time from point t8 to point t9 in time, after the image forming apparatus was switched in operational mode from the normal mode to the economy mode. What the vertical and horizontal axes of part (b) of FIG. 9 represent are the same as the counterparts in part (a) of FIG. 9. Thus, the portions of part (b) of FIG. 9, which are similar in description to the counterparts in part (a) of FIG. 9 are not described here.

If the door 19 is briefly opened at point ta, and then, is closed at point tb, for example, in time during the period from point t8 to point t9 in time, that is, the period in which the voltage Vad is falling from Vil2 to Vil1, the following occurs: if the door 19 is briefly opened (opened at point ta in time and closed at point tb in time), it does not occur that the voltage Vb at the other end Sd of the switch 25 instantly falls to zero, because the other end Sd of the switch 25 is in connection to the condenser Cb. Thus, the voltage Vad does not fall below the threshold voltage value Vth1 for the economy mode. In other words, the voltage Vad remains greater than the threshold voltage Vth1. Therefore, it is impossible for the CPU 100 to determine whether the door 19 is opened during the period between from point ta to point tb in time.

On the other hand, as the door 19 is closed, the combination of the contact 15 and contact arm 16, which are mechanically connected to the door 19, are rotationally moved by the movement of the door 19. Thus, the contact 15 is separated from the nonvolatile memory 17. Thus, it is possible that the information outputted by the CPU 100 during the period from point ta to point tb in time, to be written into the nonvolatile memory 17 will fail to be written into the nonvolatile memory 17. In addition, it is possible that the CPU 100 will not be able recover the information which the CPU 100 is to write in the nonvolatile memory 17 during the period from point to to point tb in time.

[Embodiment 1]

Figure 1:
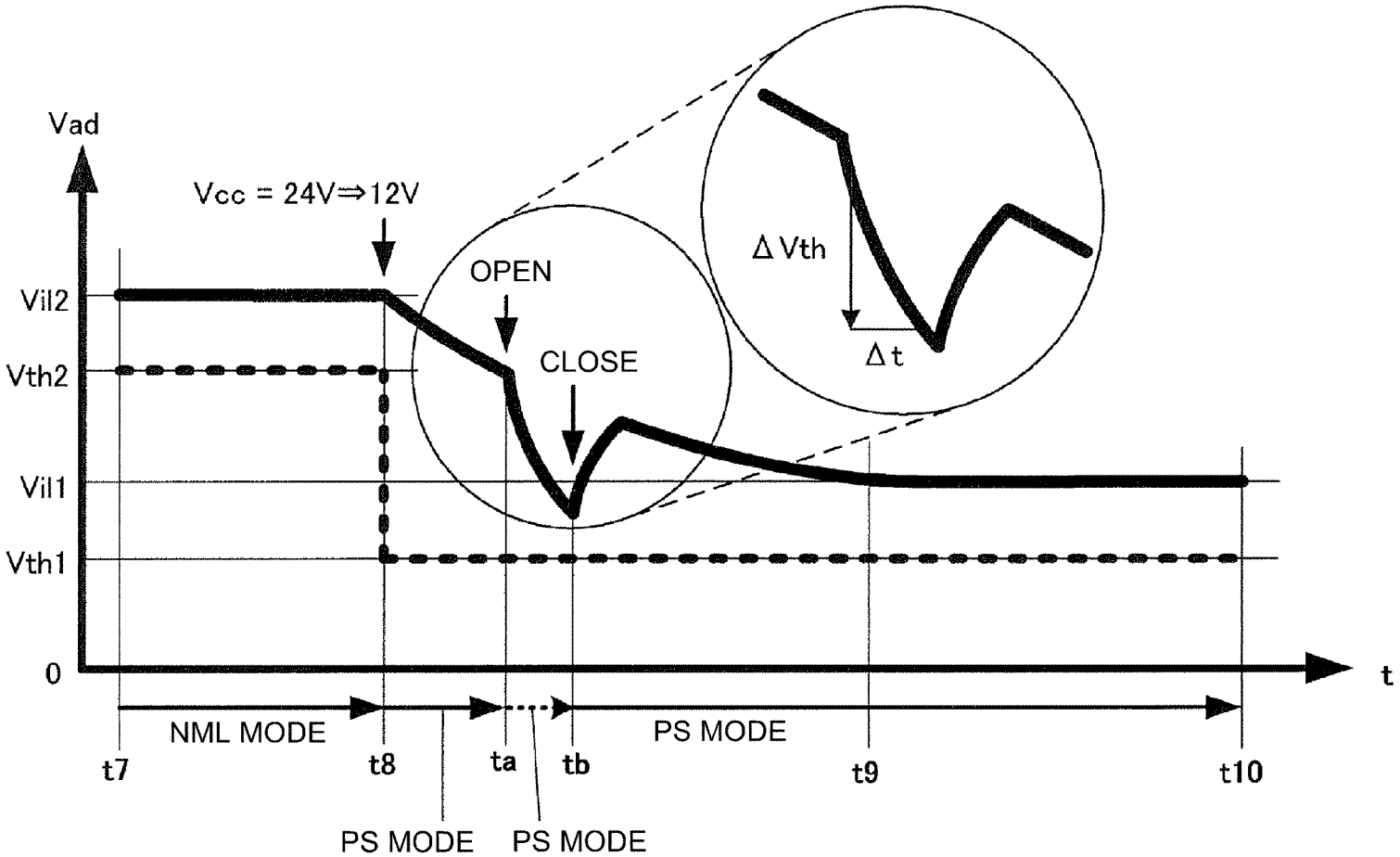
FIG. 1 is a drawing for describing the control sequence, in the first embodiment of the present invention, for detecting whether the door of an image forming apparatus is open or closed.
Figure 2:
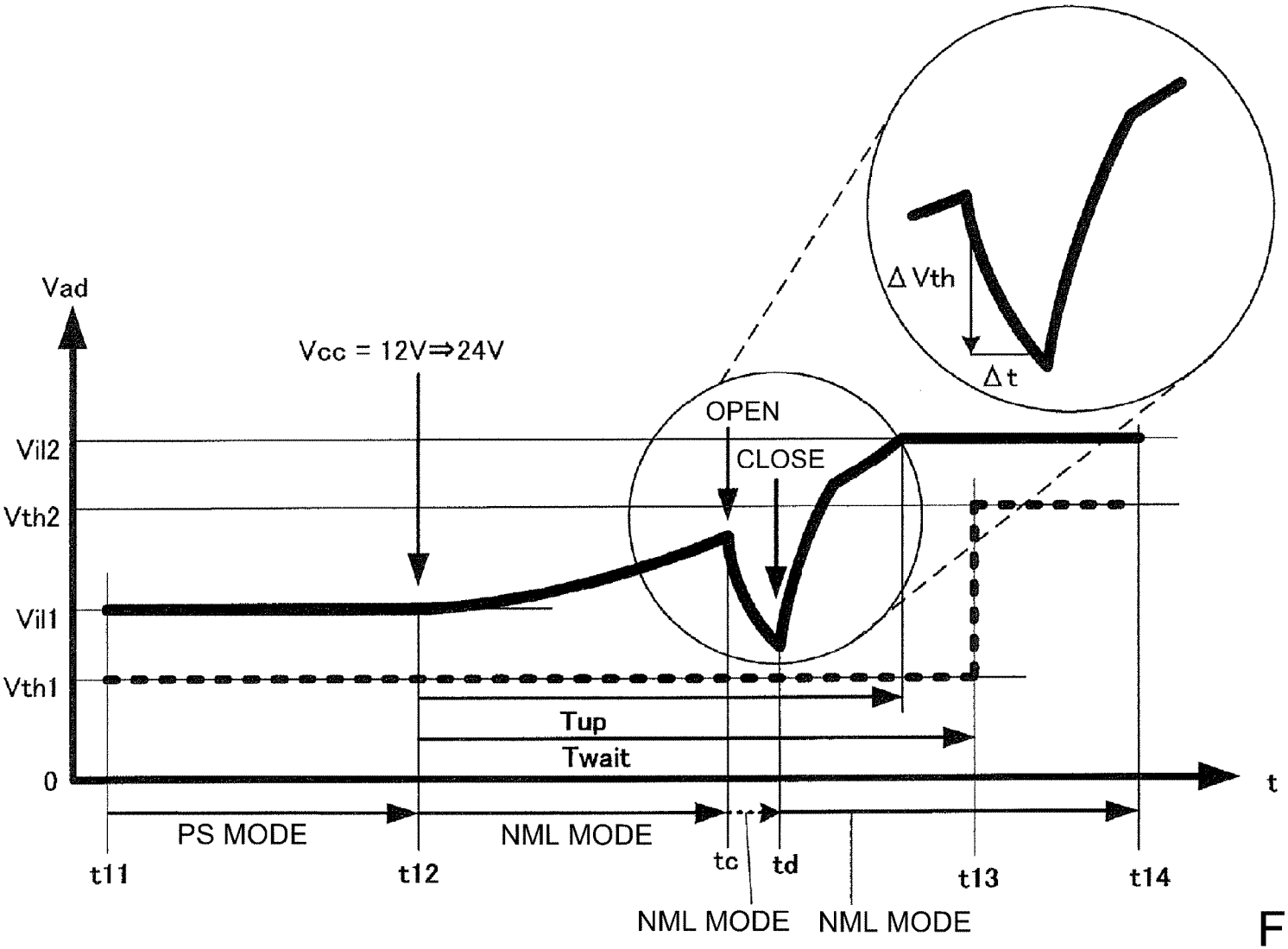
FIG. 2 also is a drawing for describing the control sequence, in the first embodiment, for detecting whether the door of the image forming apparatus is open or closed.

FIGS. 1-3 are drawing for describing the control sequence to be carried out by the apparatus, in the first embodiment of the present invention, for determining whether the door of the image forming apparatus is open or closed. The portions of FIGS. 1-3, which are the same as the counterparts in FIGS. 7 and 8(*a*) are given the same referential codes as those given to the counterparts, and are not described. The application of the present invention is not limited to image forming apparatuses structured as shown in FIG. 7, etc. That is, the present invention is applicable to any image forming apparatus as long as the apparatus is provided with a door which is similar to the door 19, and a switch which is similar to the switch 25 as a switching means. Further, the portions of FIGS. 1-3, which are similar in description to the counterparts in FIGS. 7-8(*a*) are not described here. This embodiment of the present invention is characterized in that the analog voltage Vad is continuously monitored to detect the value of the voltage Vad, in order to determine whether the door 19 is open or closed. If the change which occurred to the value of the voltage Vad, more specifically, the amount by which voltage Vad reduced, became greater than a preset value, it is determined that the door 19 is open.

[Method for Detecting Whether Door is Open or Closed while Image Forming Apparatus is Switched in Operation Mode from Normal Mode to Economy Mode]

FIG. 1 is a drawing for showing the control sequence to be carried out by the CPU 100 to determine whether the door 19 is open or closed while the image forming apparatus is switched in operational mode from the normal mode as the first mode, to the economy mode as the second mode. During the period from the point t7 to the point t8 in time, the image forming apparatus is in the normal mode, and the CPU 100, which is a determining means, determines whether the door 19 is open or closed, by comparing the voltage Vad with the threshold voltage value Vth2 which is the first threshold voltage value for the normal mode. That is, if the voltage Vad is greater than the threshold voltage value Vth2 (Vth2<Vad), the CPU 100 determines that the door 19 is closed. On the other hand, if the voltage Vad is no greater than the threshold voltage value Vth2 (Vad≤Vth2), the CPU 100 determines that the door 19 is open.

As described above, not only does the CPU 100 switch the image forming apparatus in operational mode from the normal mode to the economy mode, but also, changes the threshold voltage value Vth2 to the threshold voltage value Vth1, at point t8 in time, for example, by outputting an economy mode signal to the low voltage power source 110.

During the period from point t8 to point t10 in time, the image forming apparatus operates in the economy mode. The CPU 100 determines whether the door 19 is open or closed, by comparing the voltage Vad with the threshold voltage Vth1 (<Vth2) which is the second threshold voltage for the economy mode and is less than the threshold voltage Vth2. That is, if the voltage Vad is greater than the threshold voltage Vth1 (Vth1<Vad), the CPU 100 determines that the door is closed. On the other hand, if the voltage Vad is no more than the threshold voltage Vth1 (Vad≤Vth1), the CPU 100 determines that the door is open.

In this embodiment, the CPU 100 compares the voltage Vad with the threshold voltage Vth1 or threshold voltage Vth2, not only to determine whether the door 19 is open or closed, but also, to make the following determination: The CPU 100 monitors the voltage Vad in succession. That is, it determines in succession whether the amount, by which the voltage Vad reduced within a preset length Δt of time, is greater than the preset amount ΔVth. If it determines that the amount, by which the voltage Vad reduced within the preset length Δt of time, is greater than the preset amount ΔVth, it determines that the door 19 is open.

Referring to FIG. 1, in a case where the image forming apparatus is changed in operational mode from the normal mode to the economy mode at point t8 in time, and then, the door 19 is opened at point ta in time, and closed at point tb in time, the voltage Vad does not fall below the threshold voltage Vth1. Therefore, it is impossible for the CPU 100 to determine whether the door 19 was briefly opened during a short length of time from point ta to point tb in time, by comparing the voltage Vad with the threshold voltage Vth1. In this embodiment, however, whether the amount, by which the voltage Vad changes during the brief length Δt of time, is greater than the ΔVth, is checked in succession. Therefore, even in such a situation as the one shown in FIG. 1, the CPU 100 is enabled to detect whether the door 19 is opened or closed. Here, it is assumed that the length of the time from point ta to point tb in time is equal to the shortest length of time required to open and close the door 19, and that the preset length Δt of time is shorter than the length of time from point ta to point tb in time.

More concretely, it is assumed here that the CPU 100 has an unshown timer, which it uses to control the measurement of the preset length Δt of time. Further, it is assumed that the value of the voltage Vad at each point in time is temporarily stored in an unshown memory. If the CPU 100 detects that the value of the voltage Vad obtained at a given point in time, is less by ΔVth than the value of the voltage Vad obtained the preset length Δt of time prior to the given point in time, the CPU 100 determines that the door 19 is open.

[Method for Detecting Whether Door is Open or Closed while Image Forming Apparatus is Switched in Operational Mode from Economy Mode to Normal Mode]

FIG. 2 shows the method for detecting whether the door 19 is open or closed while the image forming apparatus is switched in operational mode from the economy mode to the normal mode. The CPU 100 stops the economy mode signal LMV which it has been outputting to the low voltage power source 110. The CPU 100 switches the low voltage power source 110 in the output voltage Vcc from 12 V, for example, which is the second DC voltage for the economy mode, to 24 V, for example, which is the first DC voltage for the normal mode. Therefore, the image forming apparatus operates in the normal mode from point t12 to point t14 in time. However, the low voltage power source 110 does not instantly switch in the amount (value) of the output voltage Vcc. That is, the output voltage Vcc becomes stable at the preset value (24 V, for example) after the elapse of the length of time required for the condensers Ca and Cd to be fully charged, and the length Tup of time required for the low voltage power source 110 to stabilized in its output voltage Vcc. Therefore, the CPU 100 switches the threshold voltage from Vth1 to Vth2 at point 13 in time, that is, after the elapse of a length Twait of time, which is the second length of time, after point t12 in time at which the CPU 100 stops the economy mode signal LVM. Here, the length Twait of time is longer than the length Tup of time (Tup<Twait>.

After the point t13 in time, the CPU 100 detects whether the door 19 is open or closed, by comparing the voltage Vad with the threshold voltage Vth2. If the CPU 100 determines that the voltage Vad is greater than the threshold voltage Vth2 (Vth2<Vad), it determines that the door 19 is closed. On the other hand, if it determines that the voltage Vad is no more than the threshold voltage Vth2 (Vad≤Vth2), it determines that the door 19 is open.

Referring to FIG. 2, in a case where the image forming apparatus is switched in operational mode from the economy mode to the normal mode at point t12 in time, and then, the door 19 is opened at a point tc in time and is closed at point td in time, the threshold voltage will have not been switched from Vth1 to Vth2. Thus, the voltage Vth1 is used as the threshold voltage Vth. Consequently, the voltage Vad does not fall below the threshold voltage Vth (Vth1). Thus, it is impossible for the CPU 100 to detect that the door 19 is open, by comparing the voltage Vad with the threshold voltage Vth (Vth1). In this embodiment, however, whether or not the amount, by which the voltage Vad changed during the preset length Δt of time, is greater than ΔVth, is detected in succession. Therefore, even in such a situation as the one shown in FIG. 2, the CPU 100 is enabled to determine whether the door 19 was briefly open and closed. It is assumed here that the preset length Δt of time is shorter than the length of time from pint tc to point td in time.

In this embodiment, not only does the CPU 100 determine whether the door 19 is open or closed, by comparing the voltage Vad with the threshold voltage Vth (Vth1 or Vth2), but also, makes the following decision: The CPU 100 monitors the voltage Vad in succession, and determines whether or not the amount, by which the voltage Vad reduced within the preset length Δt, is greater than the preset amount ΔVth. If it determines that the amount by which the voltage Vad reduced within the preset length Δt of time, is greater than the preset amount ΔVth, it determines that the door 19 is open.

As described above, in this embodiment, the CPU 100 continuously monitors the voltage Vad (analog signal). If it determines that the amount by which the voltage Vad reduced in the preset length Δt of time is greater than the preset amount ΔVth, it determines that the door 19 was open. Thus, even if the low voltage power source 110 changes in the amount of its output voltage Vcc, it is possible to accurately detect whether the door 19 is open or closed.

[Application of Method in this Embodiment for Determining Whether Door is Open or Closed, to Image Forming Apparatus]

(Recovery Operation)

Next, the effectiveness of the control sequence in this embodiment is described with reference to a case in which the present invention was applied an image forming apparatus. If an image forming apparatus is changed in operational mode from the normal mode to the economy mode, the output voltage Vcc of the low voltage power source 110 reduces from 24 V to 12 V, for example. Referring to FIG. 1, it is assumed here that while the low voltage power source 110 is reducing in its output voltage Vcc, the voltage Vad also reduces from Vil2 to Vil1 during the period from point t8 to point t9 in time. However, the other end Sd of the switch 25 is in connection to the condenser Cb. Therefore, it does not occur that as the door 19 is opened and closed for a brief length of time from point ta to point tb in time, during this period from point t8 to point t9 in time, the voltage Vb at the other end Sd of switch 25 instantly becomes zero. Therefore, the conventional method for detecting whether a door is open or closed cannot detect that the door 19 was opened at point ta in time, briefly kept open, and closed at point tb in time, as described with reference to part (b) of FIG. 9. As the door 19 is opened, the contact arm 16 to which the contact 15 is attached is mechanically moved by the movement of the door 19, separating thereby the contact 15 from the nonvolatile memory 17 which is the first storing means. Therefore, it is possible that the information to be written into the nonvolatile memory 17 during the period from point ta to point tb in time will not accurately written into the nonvolatile memory 17. In addition, the CPU 100 cannot detect that the door 19 was briefly opened. Therefore, it cannot recover the information stored in the nonvolatile memory 17.

In comparison, with the use of the above-described control sequence, in this embodiment, for detecting whether the door 19 is open or closed, the CPU 100 is enabled to detect whether the door 19 is open or closed even if the door 19 is briefly opened from point ta to point tb in time. As the door 19 is opened, the contact arm 16 to which the contact 15 is attached is mechanically moved by the movement of the door 19, separating thereby the contact 15 from the nonvolatile memory 17. Thus, it is possible that the information to be written into the nonvolatile memory 17 during the period from point ta to point tb in time will not be accurately written into the nonvolatile memory 17. In this embodiment, however, if the CPU 100 detects that the door 19 is open, it temporarily stores the information, which needs to be written into the nonvolatile memory 17 during the period from point ta to point tb in time, in a RAM 100*b* or the like, which is the second storing means. For example, the CPU 100 stores the most recent portion (which corresponds to length Δt of time) of the information written into the nonvolatile memory 17, in the RAM 100*b* or the like. Then, as the CPU 100 detects that the door 19 was opened and closed, it reads the portion (which corresponds to length Δt of time) of the information which was temporarily stored in the RAM 100*b* or the like, and write it into the nonvolatile memory 17 to restore the information.

(Initializing Operation)

Next, other effects of the control sequence, in this embodiment, for detecting whether the door is open or closed, are described with reference to a case in which the present invention is applied to an image forming apparatus is described. Part (a) of FIG. 3 is a sectional view of the image forming apparatus when the door of the apparatus is closed. The difference between part (a) of FIGS. 3 and 7 is that in part (a) of FIG. 3, a cartridge 9 which is removably installable in the main assembly of the image forming apparatus is separable into the first portion 9*a*, which is the first image forming portion, and in which a photosensitive drum 5 and a charge roller 6 are contained, and the second portion 9*b* which is the second image forming portion, and in which a development sleeve 7 and toner are contained. In the case of the image forming apparatus shown in part (a) of FIG. 3, the second portion 9*b* of the cartridge 9 is rotatable about an axle 20, being allowed to be separated from the first portion 9*a* as shown in part (b) of FIG. 3. If the image forming apparatus is structured so that when the image forming apparatus is on standby, the photosensitive drum 5 always remain in contact with each other, it is possible that the development sleeve 7 will be deformed. Thus, in order to prevent the development sleeve 7 from being deformed, the image forming apparatus is structured so that the first and second portions 9*a* and 9*b*, respectively, are separable from each other. The operation for separating the first and second portions 9*a* and 9*b* from each other, and the operation for placing the two portions 9*a* and 9*b* in contact with each other, are carried out by the driving force from a motor 21 which is a driving means.

The electric power to be supplied to the motor 21 to cause the first and second portions 9*a* and 9*b* in the cartridge 9 to come into contact with each other, or to separate from each other, is supplied from the downstream side (where other end Sd is (part (a) of FIG. 8) of the switch 25. Therefore, if the door 19 is open, and therefore, the switch 25 is off, electric power is not supplied to the motor 21, and therefore, the second portion 9*b* cannot be separated from, or placed in contact with, the first portion 9*a*. Thus, the image forming apparatus in this embodiment is structured so that there is mechanical (physical) connection between the door 19 and cartridge 9 (second portion 9*b*), and also so that as the door 19 is opened, the first and second portions 9*a* and 9*b* of the cartridge 19 are separated from each other by the opening movement of the door 19. That is, the apparatus is structured so that the first and second portions 9*a* and 9*b* are separable without using the driving force from the motor 21. By the way, the force for separating the first and second portions 9*a* and 9*b* from each other, and for placing the first and second portions 9*a* and 9*b* in contact with each other, while the door 19 is closed, are the force from the motor 21. Part (b) of FIG. 3 is a sectional view of the image forming apparatus in this embodiment when the door 19 is open. It shows the structure of the apparatus. As the door 19, which is open, is closed, the motor 21 is driven to place the first and second portions 9*a* and 9*b* of the cartridge 9 in contact with each other. This operation is referred to as "initializing operation".

As the image forming apparatus structured as shown in FIG. 3 is switched in operational mode from the normal mode to the economy mode, the output voltage Vcc of the low voltage power source 110 reduces. Further, during the period from point t8 to point t9 in time, the voltage Vad also reduces from Vil2 to Vil1. If the door 19 is opened at point ta, briefly kept open, and closed at point tb, during the period from point t8 to point t9 in time, in which the low voltage power source 110 is reducing in its output voltage Vcc, the voltage Vb at the other end Sd of the switch 25 does not instantly become zero, because the other end Sd of the switch 25 is in connection to the condenser Cb. Therefore, a conventional control sequence, shown in part (b) of FIG. 9, for detecting whether the door is open or closed cannot detect whether the door 19 is briefly opened (and closed) in the above-described situation. As the door 19 is opened at point ta in time, the second portion 9*b* of the cartridge 9 is separated from the first portion 9*a* of the cartridge 9 by the combination of the mechanical (physical) connection between the door 19 and cartridge 9, and the opening movement of the door 19. However, in the case of the conventional control sequence for detecting whether the door 19 is open or closed, even when the door 19 becomes completely closed at point tb in time, the CPU 100 cannot detect that the door 19 is closed. Therefore, the initializing operation, which places the first and second portions 9*a* and 9*b*, respectively, in contact with each other is not carried out. That is, the conventional control sequence suffers from a problem that the image forming apparatus erroneously operates.

In comparison, in a case where the above-described control sequence, in this embodiment, for detecting whether the door is open or closed, is employed, whether the door is open or closed can be detected, even if the door is only briefly opened (and closed) as described above. Therefore, as the door 19, which was opened at point to in time, is closed at point tb in time, the motor 21 can be driven, and therefore, the initializing operation which places the first and second portions 9*a* and 9*b* of the cartridge 9 in contact with each other can be carried out.

As described above, according to this embodiment, it is possible to accurately detect whether the door is open or closed, even if the output voltage of the power source changes.

[Embodiment 2]

In the first embodiment, the CPU 100 continuously monitors the analog voltage Vad to detect the change in the detection signal (analog), which occurs as the door 19 is opened or closed. If the amount, by which the voltage Vad reduces within the preset length Δt of time, becomes greater than the preset amount ΔVth, the CPU 100 determines that the door 19 is open. In the first embodiment, the preset amount ΔVth1 to be compared with the amount, by which the analog voltage Vad reduces during the preset length Δt of time, is decided as follows: That is, in the first embodiment, the preset amount ΔVth to be compared with the amount by which the voltage Vad reduces within the preset length Δt of time when the image forming apparatus is switched in operational mode from the normal mode to the economy mode, is the same as the preset amount Δt to be compared with the amount, by which the voltage Vad reduces within the preset length Δt of time when the image forming apparatus is switched in operational mode from the economy mode to the normal mode. Making the preset amount ΔVth to be used when the image forming apparatus is switched in operational mode from the economy mode to the normal mode, the same as the preset amount ΔVth to be used when the image forming apparatus is switched in operational mode from the normal mode to the economy mode, is advantageous in that it can simplify the control sequence to be carried out by the CPU 100 to determine whether the door 19 is open or closed.

On the other hand, the amount by which the analog voltage Vad reduces during the preset length Δt of time, is affected by the changes in the output voltage Vcc of the low voltage power source 110. In the second embodiment, therefore, in order to more accurately detect whether the door 19 is open or closed, the amount ΔVth is preset according to the amount of change which occurs to the output voltage Vcc. Next, the control sequence, in the second embodiment, for detecting whether the door 19 is open or closed, is described. By the way, if a given portion of the image forming apparatus in this embodiment is the same in structure as the one described above, the given portion is given the same referential codes as the counterpart in the first embodiment, and is not described here.

[Control Sequence for Detecting Whether Door is Open or Closed while Image Forming Apparatus is Switched in Operational Mode from Normal Mode to Economy Mode]

An amount ΔVtha to be used for detecting whether the door 19 is open or closed after the image forming apparatus is changed in operational mode from the normal mode to the economy mode at point t8 in time in part (a) of FIG. 4 is obtained with the use of the value Vad(t=t1−Δt) of the voltage Vad obtained at a point in time which is earlier by a preset length (t1−Δt) than point t1 in time, and the following equation (1):

$$\Delta Vtha=\alpha\times Vad(t=t1-\Delta t) \quad (1)$$

wherein α is a constant which is preset, through experiments, based on the relationship between the output voltage Vcc and the voltage value Vad (t=t1−Δt) of the voltage Vad at a preset point (t1−Δt). In this embodiment, if the amount by which the voltage Vad reduces within a preset length Δt of time, is greater than the voltage value ΔVtha calculated with the use of equation (1), the CPU 100 determines that the door 19 is open.

[Control Sequence for Detecting Whether Door is Open or Closed while Image Forming Apparatus is Switched in Operational Mode from Economy Mode to Normal Mode]

Referring to part (b) of FIG. 4, after the image forming apparatus is switched in operational mode from the economy mode to the normal mode at a point t12 in time, the value ΔVthc to be used to detect whether the door 19 is open or closed is obtained with the use of the voltage value Vad (t=t2−66 t) obtained at a preset point (t2−Δt) in time, which is earlier by the preset length Δt of time than the point t2 in time, and the following equation (2):

$$\Delta Vthc=\alpha\times Vad(t=t2-\Delta t) \quad (2)$$

wherein α is the same as α in equation (1).

In this embodiment, if the amount by which the voltage Vad reduces during the preset length Δt of time is greater than the value ΔVthc calculated with the use of equation (2), the CPU 100 determines that the door is open. As described above, in this embodiment, the ΔVth (ΔVtha, ΔVthc), with which the amount by which the voltage Vad reduces is compared, is set according to the change in the output voltage Vcc of the low voltage power source 110, that is, the change in the voltage Vad. Therefore, it is possible to more accurately detect whether the door 19 is open or closed.

As described above, according to this embodiment, even if the power source changes in output voltage, whether the door is open or closed can be more accurately detected.

[Embodiment 3]

In the first and second embodiments, the voltage Vad was compared with the threshold voltage Vth1 and threshold voltage Vth2, respectively, to detect whether the door 19 is open or closed. Further, the amount by which the voltage Vad reduces within the preset length Δt of time, was compared to the preset amount ΔVth, to detect whether the door 19 is open or closed. If the amount by which the voltage Vad reduces within the preset length Δt of time becomes greater than the preset amount ΔVth, the CPU 100 determined that the door 19 is open. Also in the third embodiment, the voltage Vad is monitored. However, in the third embodiment, in order to make simpler the control sequence for detecting whether the door 19 is open or closed, if the amount by which the voltage Vad reduces within the preset length Δt of time becomes greater than a preset amount ΔVth, the CPU 100 determines that the door 19 is open. By the way, a given portion in this embodiment is the same in description as the counterpart in the preceding embodiments, it is given the same referential code, and is not described.

[Method for Detecting Whether Door is Open or Closed in Normal Mode]

FIG. 5 is a drawing for describing the method, in this embodiment, for detecting whether the door is open or closed. More specifically, referring to FIG. 5, a method for detecting whether the door 19 is open or closed between point t20 to point t21 in time while the image forming apparatus is in the normal mode, is described. It is assumed here that the door 19 is opened at point to in time, and closed at point tf in time. A value ΔVthe to be used for detecting whether the door 19 is open or closed is obtained with the use of the voltage value Vad (t=t3 −Δt) obtained at a preset point (t3−Δt) in time, which is earlier by the preset length Δt of time than the point t3 in time, and the following equation (3) following equation (3):

$$\Delta Vthe=\alpha\times Vad(t=t3-\Delta t) \quad (3)$$

wherein α is the same as α in equations (1) and (2).

If the CPU 100 determines that the amount by which the voltage Vad reduces within the preset length Δt of time is greater than the value ΔVthe calculated with the use of equation (3), it determines that the door 19 is open.

[Method for Detecting Whether Door is Open or Closed in Economy Mode]

Referring to FIG. 5, a method for detecting whether the door 19 is open or closed during a period from point t22 to point t23 in time in the economy mode is described. It is assumed here that the door 19 is opened at point tg in time, and closed at point th in time. A value ΔVthg to be used for detecting whether the door 19 is open or closed is obtained with the use of the voltage value Vad (t=t4−Δt) obtained at a preset point (t4−Δt) in time, which is earlier by the preset length Δt of time than the point t4 in time, and the following equation (4):

$$\Delta Vthg=\alpha\times Vad(t=t4-\Delta t) \quad (4)$$

wherein α is the same as α in equations (3).

If the CPU 100 determines that the amount by which the voltage Vad reduces within the preset length Δt of time is greater than the value ΔVthg calculated with the use of equation (4), it determines that the door 19 is open.

[Method for Detecting Whether Door is Open or Closed while Image Forming Apparatus is Switched in Operational Mode from Normal Mode to Economy Mode]

Referring to part (a) of FIG. 6, a method for detecting whether the door 19 is open or closed after the image forming apparatus was switched in operational mode from the normal mode to the economy mode is described. It is assumed here that the door 19 is opened at point tp in time and closed at point tq in time. A value ΔVthp to be used for detecting whether the door 19 is open or closed is obtained with the use of the voltage value Vad (t=t5−Δt) obtained at a preset point (t5−Δt) in time, which is earlier by the preset length Δt of time than the point t5 in time, and the following equation (5):

$$\Delta Vthp=\alpha\times Vad(t=t5-\Delta t) \quad (5)$$

wherein α is the same as α in equations (3).

If the CPU 100 determines that the amount by which the voltage Vad reduces within the preset length Δt of time is greater than the value ΔVthp calculated with the use of equation (4), it determines that the door 19 is open.

[Method for Detecting Whether Door is Open or Closed while Image Forming Apparatus is Switched in Operational Mode from Economy Mode to Normal Mode]

Referring to part (b) of FIG. 6, a method for detecting whether the door 19 is open or closed after the image forming apparatus was switched in operational mode from the economy mode to the normal mode is described. It is assumed here that the door 19 is opened at point tr in time and closed at point is in time. A value ΔVthq to be used for detecting whether the door 19 is open or closed is obtained with the use of the voltage value Vad (t=t6−Δt) obtained at a preset point (t6−Δt) in time, which is earlier by the preset length Δt of time than the point t6 in time, and the following equation (6):

$$\Delta Vthq=\alpha\times Vad(t=t6-\Delta t) \quad (6)$$

wherein α is the same as α in equations (3).

If the CPU 100 determines that the amount by which the voltage Vad reduces within the preset length Δt of time is greater than the value ΔVthq calculated with the use of equation (6), it determines that the door 19 is open.

As described above, in this embodiment, the analog voltage Vad, (detection signal) is continuously monitored. Then, if the amount by which the voltage Vad reduces within the preset length Δt of time becomes greater than the preset value (ΔVthe, ΔVthg, ΔVthp or ΔVthq), the CPU 100 determines that the door 19 is open. In this embodiment, whether the door 19 is open or closed is detected based on only the amount by which the voltage Vad reduces. That is, this embodiment can simplify the control sequence for detecting whether the door 19 is open or closed.

[Embodiment 4]

The first to third embodiments were concerned with the methods for accurately detecting whether the door 19 is open or closed, even if the power source changes in its output voltage. This embodiment which is described next concerns a method for detecting whether the door is open or closed, which is significantly smaller in power consumption than any conventional method.

FIG. 10 shows the structure of the electrical circuit in this embodiment. FIG. 11, which is a timing chart, shows the method, in this embodiment, for detecting whether the door is open or closed. The structure of the image forming apparatus in this embodiment is the same as the one shown in FIG. 7. In this embodiment, in the economy mode in which a high level of responsiveness is not required when whether the door 19 is open or closed is detected, the voltage Vad is detected through a general-purpose input circuit. That is, this embodiment is characterized in that in the economy mode, the operation of an A/D conversion input module is stopped during the detection of whether the door is open or closed, in order to reduce the CPU 100 in power consumption. By the way, the electrical connections shown in FIG. 10, which are the same as those in FIG. 8 are not described.

Referring to FIG. 10, the CPU 100 is provided with an internal A/D conversion input module, which can be turned on or off. Further, the input terminal of the CPU 100, which is for detecting the voltage Vad, is provided with a terminal which doubles as an A/D conversion input port and a general-purpose input port. By the way, "general-purpose input port" means such an input port that transmits the analog voltage value signals without converting them into digital signals. In this embodiment, the A/D conversion input module is not used, and therefore, the apparatus is smaller in power consumption by an amount equal to the amount of power consumption by the A/D conversion input module.

Next, referring to FIG. 11, the method for detecting whether the door is open or closed is described. Part (a) of FIG. 11 shows the changes which occurs to the voltage Vad as the door 19 is opened (or closed). Part (b) of FIG. 11 shows the changes which occur to the voltage Vad as the door 19 is opened or closed (open to close). By the way, a value Vth2 is a threshold value for determining whether the door 19 is open or closed while the image forming apparatus is in the normal mode, whereas a value Vth1 is a threshold value for determining whether the door 19 is open or not while the image forming apparatus is in the economy mode. When the image forming apparatus is in the normal mode, the CPU 100 detects the voltage Vad with the use of the A/D conversion input module. It detects whether the door 19 is open or closed by comparing the voltage Vad with the threshold value Vth2. More concretely, if Vth2<Vad, the CPU 100 determines that the door 19 is closed. If Vad≤Vth2, the CPU 100 determines that the door is open. Thus, if the door 19 is opened at point t2 in time as shown in part (c) of FIG. 11, the CPU 100 determines that during a period from point t1 to point t3 in time, the door 19 is closed, and also, that at point t3 in time and thereafter, the door 19 is open.

The CPU 100 uses the general-purpose circuit to detect the voltage Vad. That is, when the image forming apparatus is in the economy mode, the CPU 100 keeps the A/D conversion input module turned off. It compares voltage Vad with the threshold value Vth2 (Vth2<Vth1). If Vth2<Vad, the CPU 100 determines that the door 19 is closed. If Vad≤Vth2, it determines that the door is open. Referring to part (d) of FIG. 11, if the door 19 is opened at point t2 in time, it determines that during a period from point t1 to point t6 in time, the door is closed, and at point t6 in time and thereafter, the door 19 is open. Since the A/D conversion module remains turned off, the CPU 100 is smaller in power consumption by an amount equal to the amount of power consumption by the A/D conversion module.

Next, the operation which is carried out by the CPU 100 when the above-described method, in this embodiment, for detecting whether the door 19 is open or closed is used is described. Referring to FIG. 11, while the motor M is in operation, the voltage of the condenser Cb is affected by the counter electromotive force from the motor M. Therefore, it does not occur that as the door 19 is opened, the voltage Vad instantly becomes zero. That is, the voltage Vad gradually falls. When the image forming apparatus is in the normal mode, the A/D conversion input module is used to detect the voltage Vad to determine whether the door 19 is open or closed. Therefore, whether the door 19 is open or closed can be detected in a short length of time, as soon as the door 19 is opened. As the door 19 is opened, the contact arm 16, which is mechanically linked (unshown) with the door 19, is rotationally moved by the movement of the door 19, separating thereby the contact 15 from the nonvolatile memory 17. Thus, it becomes impossible for the data to be written into the nonvolatile memory 17. However, the timing with which whether the door 19 is open or closed is quickly detected after the door 19 is opened. Therefore, there is a sufficient amount of time for the CPU 100 to write the information into the nonvolatile memory 17 after the detection of the state (open or closed) of the door 19.

On the other hand, after the image forming apparatus is switched in operational mode from the normal mode to the economy mode, the CPU 100 is prevented from communicating with the nonvolatile memory unit 17. Further, the input terminal of the CPU 100, which is for detecting the voltage Vad, is switched in connection, from the A/D conversion module to the general-purpose input circuit. Then the electric power source for the A/D conversion input module in the CPU 100 is turned off. Thus, even if it becomes necessary for the CPU 100 to communicate with the non-volatile memory unit 17, the communication has to be postponed until the image forming apparatus is switched in operation mode from the economy mode to the normal mode.

Next, referring to FIG. 12, a method for detecting whether the door 19 is open or closed while the image forming apparatus is in the economy mode is described. In the economy mode, the CPU 100 detects the voltage Vad through the general-purpose input port, in order to detect whether the door 19 is open or closed. In the economy mode, it takes a longer length (t6–t2) of time to detect the state (open or closed) of the door 19 than in the normal mode (t5–t2). Thus, if the door 19 is very briefly (roughly several hundreds of milliseconds: t5–t2) opened (and closed), during a period from point t2 to point t6 in time, the CPU 100 cannot detect the state (open or closed) of the door 19. In the economy mode, however, the CPU 100 is prevented from communicating with the non-volatile memory unit 17. Therefore, the anomaly does not occur. Therefore, the detection is unnecessary. On the other hand, regarding the power consumption, the A/D conversion input module in the CPU 100 is kept turned off. Therefore, the CPU 100 is smaller in power consumption by an amount equal to the amount of power consumption by the A/D conversion input module. More concretely, in this embodiment, the power consumption is smaller by roughly 20 mW.

[Embodiment 5]

In this embodiment, multiple (two) motors which are different in specification are used. It is assumed that the CPU 100 detects the value of the voltage Vad through the A/D conversion input module, and switches the apparatus in motor control, based on the detected value of the voltage Vad. That is, this embodiment is characterized by the method for reducing in power consumption, an image forming apparatus, in which motors are optimally controlled based on their type.

It occurs sometimes that the motors purchased for the manufacturing of image forming apparatuses are different in specification, because they were purchased from multiple makers (venders), for example. Even if the motors are different in specifications, each motor in the driving portion for conveying sheets of recording medium can be optimized in terms of the gain in rotation control to minimize the motor in the fluctuation in rotational speed, in order to obtain desirable images.

FIG. 13 shows electrical connections in this embodiment. The portions of the electrical circuit shown in FIG. 13, which are same as the counterparts in FIG. 10, are not described here. The differences between FIG. 13 from FIG. 12 are described next. It is assumed here than the image forming apparatus is equipped with a motor M1, which is supplied by a vendor 1, or a motor M2, which is supplied by a vender 2. The CPU 100 is provided with an internal nonvolatile memory unit 17. The optimal gain value for the rotation control for each of the two motors which are different in vender is stored in the storage portion of the nonvolatile memory unit 17. Referring to part (b) and part (c) of FIG. 13, the two motor units are different in vender.

The image forming apparatus is provided with only one CPU 100 and only one low voltage power source 110. There is no issue regarding the difference in product specification among multiple venders. Each of motor units 1 and 2 is equipped with its own pair of resistors which generate voltage Vad. The motor unit 1 from a vender 1 is provided with a pair of resistors Ra1 and Rb1, whereas the motor unit 2 from a vender 2 is provided with a pair of resistors Ra2 and Rb2. There is the following mathematical relation among the their resistance values:

$$Rb1/(Ra1 \neq Rb1)+Rb2/(Ra2+Rb2) \quad (7)$$

Further, the value of the voltage Vad for each motor unit when the door 19 is closed are obtained with the use of the following equations (8) and (9): Value (Vil1) for voltage Vad when motor unit 1 is in use and door is closed $$=Rb1/(Ra1+Rb1)\times Vb \quad (8)$$

Value (Vil2) for voltage Vad when motor unit 2 is in use and door is closed $$=Rb2/(Ra2+Rb2)\times Vb \quad (9)$$

Further, the relationship among Vil1, Vil2, motor identification, and threshold voltage value Vth3 is as expressed by the following inequity (10):

$$Vil2 > Vth3 > Vil1 \quad (10).$$

FIG. 14 is a flowchart which shows the method for determining a constant for controlling the motor M during the transition to the normal mode. Next, the determining method is described.

As the image forming apparatus is switched in operational mode from the economy mode (S01), the CPU 100 detects the value of the voltage Vad through the A/D conversion input module, and detects whether the door 19 is open or closed (S02). If Vad≤Vth1, the CPU 100 determines that the door is closed (S04), and continues to detect the state (open or closed) of the door 19 until the door 19 is closed (S03). If Vad>Vth1, the CPU 100 determines that the door 19 is closed (S04), and proceeds to S05. If Vad>Vth3 in S05, the CPU 100 determines that the motor M1 from the vender 1 is in connection. Then, it sets up the apparatus so that the motor M1 is driven with the use of the optimal constant for the motor M1 (S06). Then, it puts the apparatus on standby (S08). On the other hand, if Vad≤Vth3 in S05, the CPU 100 determines that the motor M2 from the vender 2 is in connection, and sets the apparatus so that the motor M2 is controlled with the use of the optimal constant for the motor M2 (S07), and puts the apparatus on standby (S08). As described above, if the CPU 100 determines in the normal mode that the door 19 is closed, it detects the value of the voltage Vad through the A/D conversion input module. Thus, it is possible to optimally control each motor in rotation.

On the other hand, in the economy mode, the CPU 100 detects the value of the voltage Vad through the general-purpose circuit, to determine the condition (open or closed) of the door 19. Therefore, the CPU 100 cannot detect the value of the voltage Vad while the door 19 is remaining closed, and therefore, it cannot identify the motor in use. However, in the economy mode, the image forming apparatus does not form images. Therefore, it is not necessary to drive the motor M, and therefore, it is not necessary to identify the motor M. Therefore, the value of the voltage Vad may be detected through the general-purpose circuit. By the way, regarding the power consumption, in the economy mode, the A/D conversion input module in the CPU 100 is remaining inactivated. Therefore, the power consumption is smaller by an amount equal to the amount of power consumption by the A/D conversion input module.

With the image forming apparatus being structured as described above, in a case where multiple (two) motors M which are different in specifications are used, the CPU 100 detects the value of the voltage Vad through the A/D conversion input module while the door 19 is closed. Then, it switches motor control based on the results of the detection. Thus, it is possible to optimally control each motor in rotation according to its specification, and also, reduce the apparatus in power consumption when the apparatus is in the economy mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-203803 filed on Oct. 15, 2015, and 2016-147495 filed on Jul. 27, 2016, which are hereby incorporated by reference herein in their entirety.

What is claimed is:

1. An open-close discriminating apparatus comprising:

an output portion configured to output a DC voltage having been converted from an AC voltage;

a switch portion having an end connected with said output portion, said switch portion being configured to supply the DC voltage outputted to said output portion to a load when said switch portion is in a closed state, and to shut off the supply when said switch portion is in an open state;

a capacitor connected with the other end of said switch portion; and a discriminating portion configured to discriminate whether said switch portion is in the open state or the closed state on the basis of a change amount of a voltage of the other end of said switch portion, wherein said discriminating portion is swichably operable in a first mode in which a first DC voltage is outputted from said output portion and a second mode in which a second DC voltage lower than the first DC voltage is outputted from said output portion, and wherein, when the mode is switched between the first mode and the second mode, said discriminating portion discriminates the state of said switch portion on the basis of the change amount of the voltage at the other end of said switch portion in a predetermined time period.

2. The apparatus according to claim 1, wherein said discriminating portion discriminates that said switch portion becomes the open state when the change amount exceeds a predetermined amount.

3. The apparatus according to claim 1, wherein the change amount is determined on the basis of the DC voltage outputted from said output portion.

4. The apparatus according to claim 3, wherein the change amount is determined on the basis of a voltage of the other end of said switch portion at predetermined time and a predetermined constant.

5. The apparatus according to claim 1, wherein in the first mode, the voltage of the other end of said switch portion is compared with a first threshold to discriminate whether the switch portion is in the open state or in the closed state, and when in the second mode, and wherein in the second mode, the voltage of the other end of said switch portion is compared with a second threshold lower than the first threshold to discriminate whether the switch portion is in the open state or in the closed state.

6. The apparatus according to claim 5, wherein when the mode is shifted from the first mode to the second mode, the threshold is switched from the first threshold to the second threshold, and wherein, when the mode is shifted from the second mode to the first mode, the threshold is switched from the second threshold to the first threshold after elapse of a second predetermined period.

7. The apparatus according to claim 1, wherein the predetermined time period is a period after the switching from the first mode to the second mode, or a period after the switching from the second mode to the first mode.

8. An image forming apparatus comprising:

an output portion configured to output a DC voltage having been converted from an AC voltage;

a switch portion having an end connected with said output portion, said switch portion being configured to supply the DC voltage outputted to said output portion to a load when said switch portion is in a closed state, and to shut off the supply when said switch portion is in an open state;

a capacitor connected with the other end of said switch portion; and an openable member configured to permit access into said image forming apparatus, wherein said switch portion is in the open state when said openable member is opened, and said switch portion is in the closed state when said openable member is closed;

a discriminating portion configured to discriminate whether said switch portion is in the open state or the closed state on the basis of a change amount of a voltage of the other end of said switch portion, wherein said discriminating portion is swichably operable in a first mode in which a first DC voltage is outputted from said output portion and a second mode in which a second DC voltage lower than the first DC voltage is outputted from said output portion, and wherein, when the mode is switched between the first mode and the second mode, said discriminating portion discriminates the state of said switch portion on the basis of the change amount of the voltage at the other end of said switch portion in a predetermined time period.

9. The apparatus according to claim 8, wherein said discriminating portion discriminates that said switch portion becomes open state when the change amount exceeds a predetermined amount.

10. The apparatus according to claim 9, further comprising:

a first storing portion;

an image forming portion configured to form a toner image on a recording material; and a connecting portion configured to permit recording information relating to said image forming portion in said first storing portion, the connecting portion being connected with said first storing portion when said openable member is closed, and being disconnected from said first storing portion when said openable member is opened, wherein, when said discriminating portion discriminates the open state of said openable member, a recovering operation for said first storing portion is carried out.

11. The apparatus according to claim 10, further comprising a second storing portion configured to store latest information to be written in said first storing portion, in a period from discrimination of the opening of said openable member to discrimination of the closing of said openable member, the latest information being a part of the information relating to the image forming apparatus, wherein the recovery operation writes in said first storing portion the information stored in said second storing portion.

12. The apparatus according to claim 9, further comprising a first image forming portion configured to form a toner image on a recording material; a second image forming portion configured to form a toner image on the recording material, said second image forming portion being contactable to and spaceable from said first image forming portion, and said second image forming portion being spaced from said first image forming portion in interrelation with opening of said openable member, wherein when said discriminating portion discriminates the open state of said openable member, an initializing operation for said second image forming portion is carried out.

13. The apparatus according to claim 12, further comprising a driving portion configured to drive said second image forming portion, and the initializing operation makes said second image forming portion come into contact with said first image forming portion by said driving portion after said openable member is closed.

14. The apparatus according to claim 8, wherein the change amount is determined on the basis of the DC voltage outputted from said output portion.

15. The apparatus according to claim 8, wherein the change amount is determined on the basis of a voltage of the other end of said switch portion at predetermined time and a predetermined constant.

16. The apparatus according to claim 8, wherein in the first mode, the voltage of the other end of said switch portion is compared with a first threshold to discriminate whether the switch portion is in the open state or in the closed state, and when in the second mode, and wherein in the second mode, the voltage of the other end of said switch portion is compared with a second threshold lower than the first threshold to discriminate whether the switch portion is in the open state or in the closed state.

17. The apparatus according to claim 16, wherein, when the mode is shifted from the first mode to the second mode, the threshold is switched from the first threshold to the second threshold, and wherein, when the mode is shifted from the second mode to the first mode, the threshold is switched from the second threshold to the first threshold after elapse of a second predetermined period.

18. The apparatus according to claim 8, wherein the predetermined time period is a period after the switching from the first mode to the second mode, or a period after the switching from the second mode to the first mode.

* * * * *